US006375113B1

(12) United States Patent
Ishimaru et al.

(10) Patent No.: US 6,375,113 B1
(45) Date of Patent: Apr. 23, 2002

(54) WIRE WINDER AND WIRE WINDING METHOD

(75) Inventors: Yasuhiko Ishimaru; Yasuyuki Nishimoto, both of Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/562,769

(22) Filed: May 2, 2000

(30) Foreign Application Priority Data

May 13, 1999 (JP) ..... 11-132133
May 13, 1999 (JP) ..... 11-132134
Jul. 6, 1999 (JP) ..... 11-191716

(51) Int. Cl.[7] ..... B21C 47/10; B65H 54/02

(52) U.S. Cl. ..... 242/447.1; 242/445.1; 242/476.9; 242/482.4

(58) Field of Search ..... 242/447.1, 445.1, 242/482.4, 482.8, 548, 476.9, 477

(56) References Cited

U.S. PATENT DOCUMENTS 3,090,569 A * 5/1963 Beushausen ..... 242/447.1
3,951,355 A * 4/1976 Morioka et al. ..... 242/476.9
4,244,539 A 1/1981 Taneda et al.
4,668,544 A * 5/1987 Takahashi ..... 242/447.1
5,564,637 A * 10/1996 Berthold et al. ..... 242/447
5,681,006 A 10/1997 Herd et al.

FOREIGN PATENT DOCUMENTS

DE 29 22 053 A1 12/1979
DE 41 38 191 A1 5/1993
JP A-58-201564 11/1983
JP 58-207846 * 12/1983 ..... 242/447.1
JP 62-118735 * 5/1987 ..... 242/447.1
JP A-7-183152 7/1995

* cited by examiner

*Primary Examiner*—Katherine A. Matecki
(74) *Attorney, Agent, or Firm*—Oliff & Berridge PLC

(57) ABSTRACT

A coil is formed by winding a conductive wire around a winding frame that is being rotated about a rotational axis of the winding frame. Guide members contact the conductive wire being wound around the winding frame to define the winding position of the conductive wire. The guide members are supported by a link mechanism that is provided coaxially with the rotational axis so as to rotate synchronously with the winding frame. As a third actuator moves a driving link in the direction of the rotational axis, the guide members are moved in directions of a diameter of the winding frame. As a first actuator moves a holding link in the direction of the rotational axis, the guide members are moved in the direction of the rotational axis together with the holding link. As a second actuator extends or contracts an arm, one of the guide members is moved independently of another one of the guide members. The first, second and third actuators do not need to rotate together with the winding frame. Because the actuators do not need to be mounted on a rotating mechanism, the apparatus construction becomes more simple and the load on a winding frame-rotating motor can be reduced.

56 Claims, 19 Drawing Sheets

WOUND PORTION DEVIATES IF WIRE IS SET AT NORMAL POSITION.

LAST WINDING CANNOT BE RECEIVED DUE TO DEVIATION OF FIRST WINDING.

PROFILE OF FIRST CAM

PROFILE OF SECOND CAM

WIRE WINDER AND WIRE WINDING METHOD

INCORPORATION BY REFERENCE

The disclosures of Japanese Patent Application Nos. HEI 11-132133 filed on May 13, 1999 and HEI 11-191716 filed on Jul. 6, 1999, including their specifications, drawings and abstracts are incorporated herein by reference in their entireties.

BACKGROUND OF THE INVENTION

1. Field of Invention

The present invention relates to a wire winder and to a wire winding method for forming a coil by winding a conductive wire around a winding frame that is being rotated and, more particularly, to a wire winder and to a wire winding method capable of reliably defining a winding position of a conductive wire while requiring merely a simple apparatus construction. The invention also relates to a coil formed by the wire winding method.

2. Description of Related Art

In rotating electric devices, such as electric motors, generators, and the like, the number of turns of coil winding is often increased in order to increase the power output. However, a simple increase in the number of turns of coil winding results in an enlarged size of the rotating electric device. In order to avoid such a device size increase, it is a normal practice to increase the proportion of the total sectional area of the windings of a coil to the sectional area of a slot that houses the coil (hereinafter, referred to as "space factor"). The space factor can be increased by winding a conductive wire in good arrangement without leaving a gap. Coil forming methods and coil forming apparatus for winding a conductive wire in good alignment have been developed. Such a related apparatus is described in Japanese Patent Application Laid-Open No. HEI 7-183152.

To increase the space factor, the use of a rectangular conductive wire is effective. The rectangular conductive wire refers to a conductive wire having a generally rectangular or quadrangular sectional shape. The use of a rectangular wire further reduces gaps between windings of a coil, compared with the use of a wire having a circular sectional shape.

A coil with an increased space factor is typically formed by winding a conductive wire on a magnetic pole of a rotating electric device or a winding frame (core) having a shape corresponding to that of the magnetic pole in a manner of one turn at a time without leaving a gap between adjacent windings. After the wire is wound over the entire length of the coil and therefore forms a single complete winding layer, the wire is wound for the next layer over the completed layer in the same manner. In this manner, a predetermined number of winding layers are formed.

During the above-described wire winding process for forming a coil, if a positional deviation of the conductive wire occurs at the time of a turn shift, that is, a shift of the wire from one turn to the next, the shape precision of the coil degrades. If the amount of deviation of the wire increases, the number of turns of the wire in a layer will decrease.

In order to avoid such an undesired event, it is necessary to prevent a positional deviation of the wire at the time of a turn shift. For example, in Japanese Patent Application Laid-Open No. HEI 11-13051, a turn shift portion shaper unit is provided. This unit press-forms the wire to form an S-shaped turn shift portion before that portion of the wire is wound on a winding frame.

However, if the winding frame is frequently stopped in order to prevent wire deviation, the productivity of coils decreases. Therefore, it is desirable to prevent wire deviation without stopping the winding frame. To that end, it may be conceivable to rotate a wire deviation preventing unit synchronously with the winding frame. However, this technology has a drawback of increasing the size of a rotating portion of a wire winding apparatus. In particular, since an actuator for operating the unit is rotated together with the winding frame, the apparatus construction becomes complicated, and the load on a motor for rotating the winding frame increases.

SUMMARY OF THE INVENTION

Accordingly, it is an object of the invention to provide a wire winder and a wire winding method capable of preventing deviation of the winding position of a conductive wire during continuous rotation of a winding frame while employing a simple apparatus construction.

In accordance with one aspect of the invention, a wire winder for forming a coil by winding a conductive wire includes a winding frame around which the conductive wire is wound while the winding frame is being rotated. Additionally, a guide mechanism contacts the conductive wire wound around the winding frame and defines a winding position of the conductive wire. A guide support link mechanism is provided coaxially with a rotational axis of the winding frame so as to rotate synchronously with the winding frame. The guide support link mechanism supports the guide mechanism. A link driver is provided to move an element member of the guide support link mechanism in a direction of the rotational axis of the winding frame without rotating together with the winding frame and the guide support link mechanism. The guide support link mechanism converts a movement provided in the direction of the rotational axis of the winding frame by the link driver into a movement of the guide mechanism in a direction of a diameter of the winding frame.

In the above-described wire winder, the guide mechanism defines the winding position of the conductive wire by contacting the conductive wire, so that positional deviation of the conductive wire is prevented. Furthermore, the guide mechanism is supported by the link mechanism, which synchronously rotates with the winding frame. Therefore, the guide mechanism is able to function even while the winding frame is rotating.

In this embodiment of the invention, the link mechanism is designed to convert a movement in the direction of the rotational axis of the winding frame into a movement of the guide mechanism in the direction of the diameter of the winding frame. Therefore, the link driver merely needs to provide the link mechanism with a movement in the direction of the rotational axis. That is, the link driver can perform its function without needing to rotate together with the winding frame. For example, an actuator fixed to an apparatus table or the like will easily apply a force to a link that is rotating. Since the actuator does not need to rotate together with winding frame, the apparatus construction is simplified and the load on a winding frame-rotating motor can be reduced.

In the wire winding method of this embodiment of the invention, the conductive wire wound around the winding frame is contacted with a guide mechanism that defines a winding position of the conductive wire. The guide mechanism supported with a guide support link mechanism that is provided coaxially with the rotational axis so as to rotate synchronously with the winding frame. A link driver that does not rotate about the rotational axis together with either one of the winding frame and the guide support link mechanism is utilized to move a member of the guide support link mechanism in a direction of the rotational axis. The guide support link mechanism converting a movement in the direction of the rotational axis provided by the link driver into a movement of the guide mechanism in a direction of a diameter of the winding frame.

In an embodiment of the wire winding method of the invention, the winding position of a conductive wire is defined by the guide mechanism that contact opposite sides of the conductive wire at sites forward and rearward of a turn shift portion, so that positional deviation of the conductive wire is prevented. The four guide members comprising the guide mechanism can be driven independently of one another. Even where coils to be formed have different shapes of turn shift portions, the four guide members can be used to define the winding position of the conductive wire for the production of each coil. Thus, it becomes unnecessary to replace the guide members, so that productivity improves.

According to an aspect of the invention, it is not necessary that all the four guide members simultaneously contact a conductive wire. That is, the guide members may also be driven so that one or more of the guide members contact the conductive wire and the other guide members do not contact the conductive wire but are withdrawn therefrom as needed.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described hereinafter with reference to the accompanying drawings.

Figure 1:
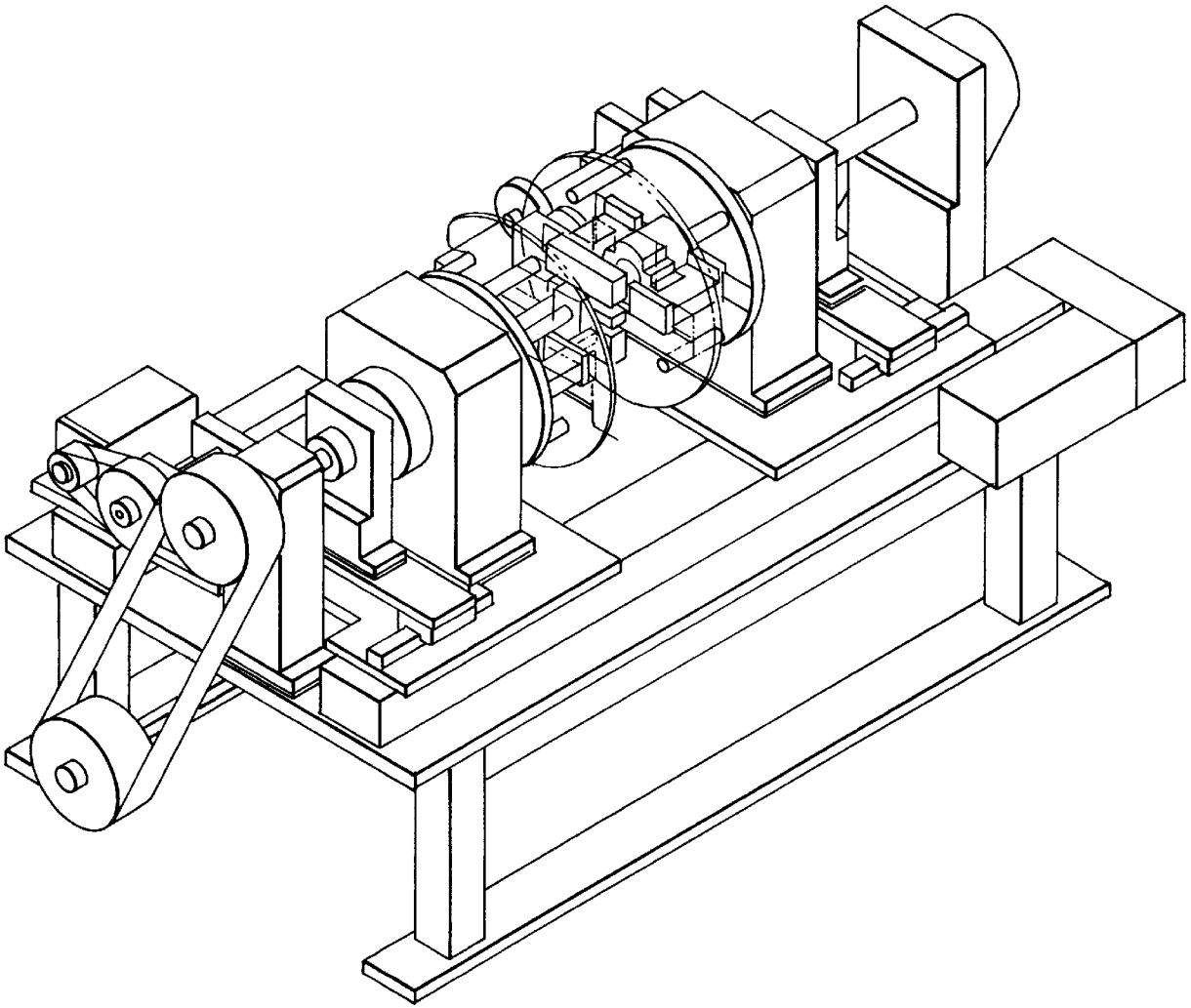
FIG. 1 is a perspective view of a wire winder according to a first embodiment of the invention.
Figure 2:
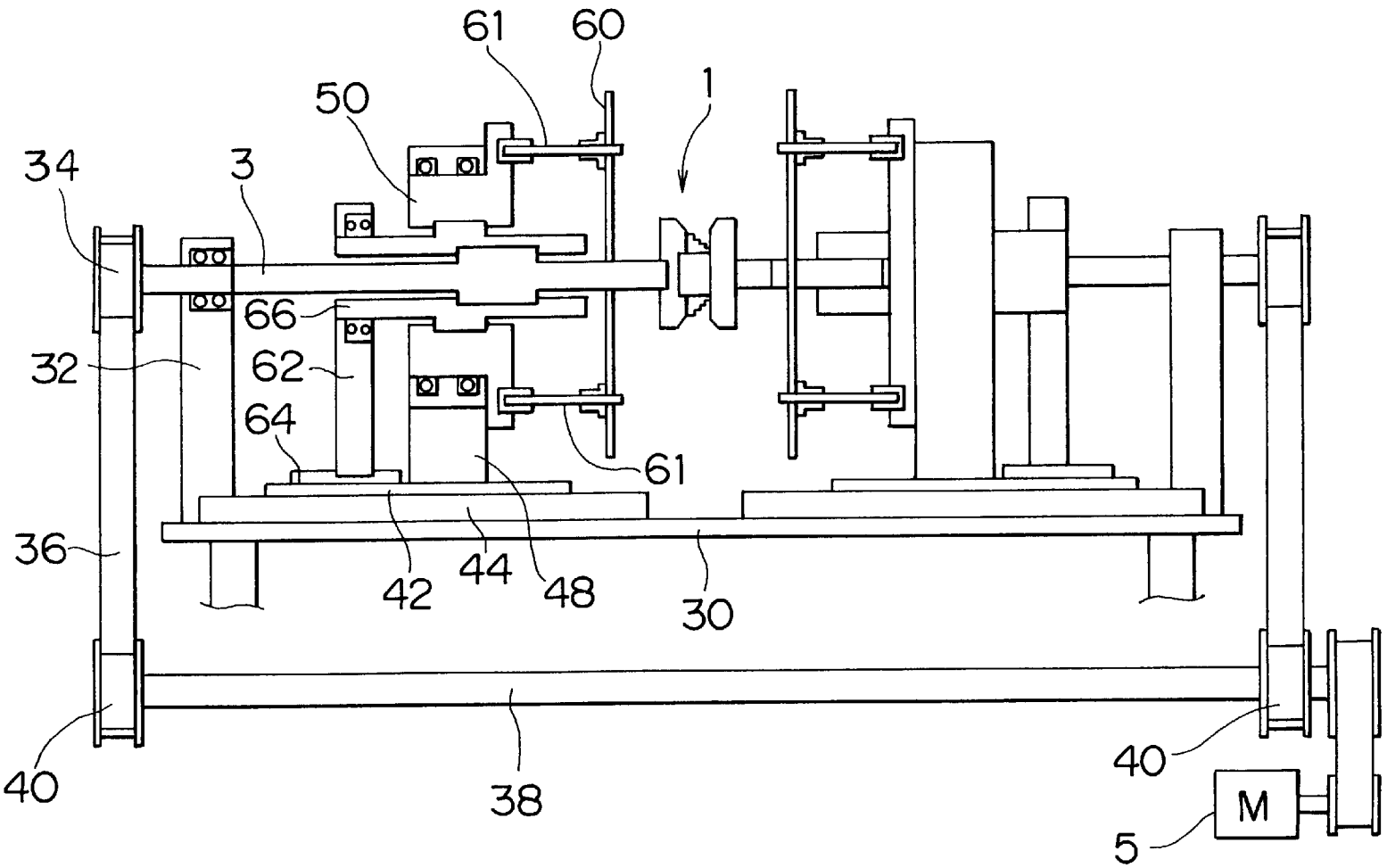
FIG. 2 is a front elevation of the wire winder shown in FIG. 1.
Figure 3:
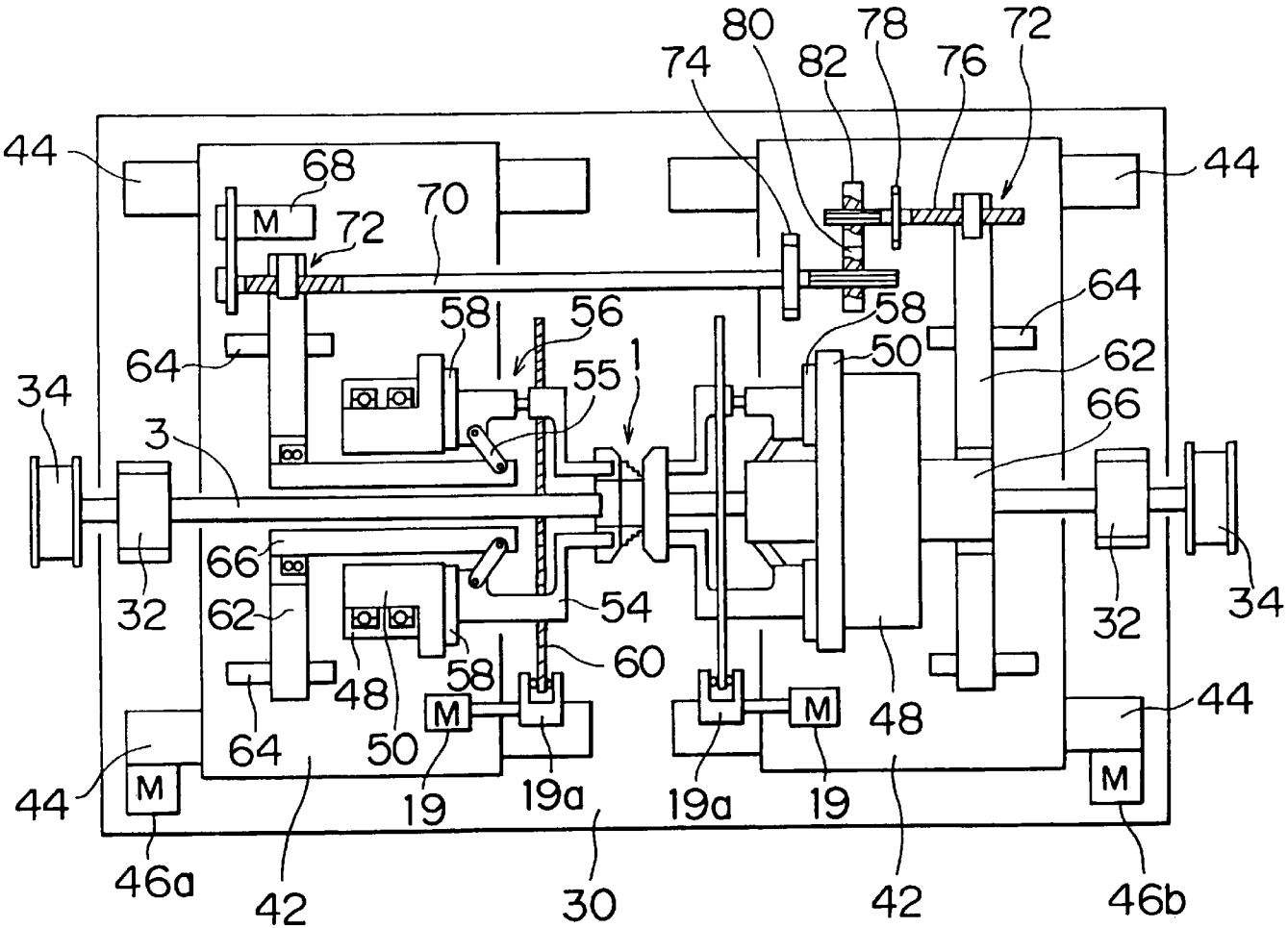
FIG. 3 is a plan view of the wire winder shown in FIG. 1.
Figure 4:
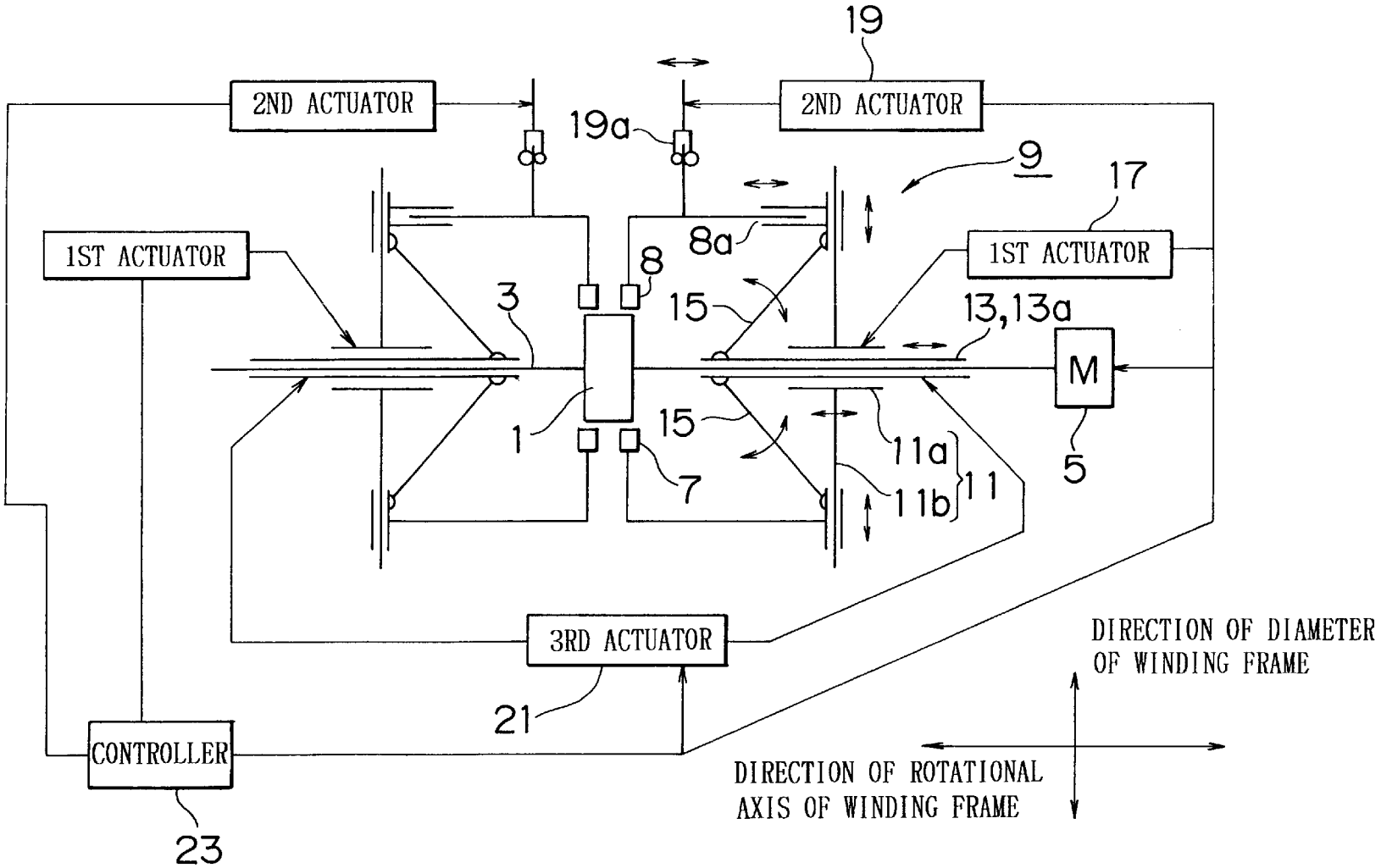
FIG. 4 illustrates a mechanism of the wire winder shown in FIG. 1.

FIG. 1 is a perspective view of a wire winder according to an embodiment of the invention. FIG. 2 is a front view of the wire winder, and FIG. 3 is a plan view thereof. To facilitate the understanding of the invention, the illustrations in the drawings are shown partially in sectional views or simplified views. FIG. 4 illustrates a mechanism of the wire winder.

With reference to FIG. 4, the mechanism of the wire winder will first be described. The wire winder has an axis-symmetrical construction. In the ensuing description, therefore, a right-side half of the construction will mainly be described. A rotating shaft 3 of a winding frame (core) 1 is rotatably supported by an apparatus base (not shown). The rotating shaft 3 is rotated by a motor 5.

Guide members 7, 8 are provided near the winding frame 1 and at opposite sides of the rotating shaft 3. The guide members 7, 8 prevent a deviation of an electrically conductive wire being wound on the winding frame 1, by contacting the wire and defining a winding position of the wire.

The guide members 7, 8 are held by a guide holding link mechanism 9 according to the invention. The link mechanism 9 is provided so as to rotate coaxially and synchronously with the rotating shaft 3, as described below. The link mechanism 9 is constructed so as to convert movements of link elements in the directions of the rotational axis thereof into movements of the guide members in directions of a diameter of the winding frame 1, that is, directions perpendicular to the rotational axis of the winding frame 1.

The link mechanism 9 has a holding link 11, a driving link 13, and a converting link 15. The holding link 11 has a first cylinder 11*a* that is provided coaxially with the rotating shaft 3 so as to rotate synchronously with the rotating shaft 3, and a radial portion 11*b* extending radially from the first cylinder 11*a*. The radial portion 11*b* has a shape of, for example, a disc. The radial portion 11*b* holds the guide members 7, 8 slidably in the directions of a diameter of the winding frame 1.

The driving link 13 is substantially formed by a second cylinder 13*a* that is provided coaxially with the rotating shaft 3 so as to rotate synchronously with the rotating shaft 3. The rotating shaft 3, the first cylinder 11*a* and the second cylinder 13*a* restrain one another in the rotational directions, but not in the directions of the rotational axis thereof. Therefore, the rotating shaft 3, the holding link 11 and the driving link 13 are movable relatively to one another in the direction of the rotational axis.

The converting link 15 connects the driving link 13 and the radial portion 11*b* of the holding link 11. As shown in FIG. 4, the converting link 15 extends diagonally to the rotating shaft 3.

The guide member 8 is supported by the holding link 11 via an arm 8a that is extendable in the direction of the rotational axis of the winding frame 1.

The operation of the link mechanism 9 shown in FIG. 4 will be described. A first actuator 17 is able to move the holding link 11 in both directions of the rotational axis. As the holding link 11 is moved relative to the rotating shaft 3 in a direction of the rotational axis, the guidemembers 7, 8 move relative to the winding frame 1 in the direction of the rotational axis.

A second actuator 19 changes the length of the extendable arm 8*a*. Therefore, the guide member 8 can be moved relative to the holding link 11 in the directions of the rotational axis so as to assume a position in the directions of the rotational axis that is different from the position of the guide member 7.

As shown in FIG. 4, the second actuator 19 has a fork 19*a* that clamps the arm 8*a* from opposite sides. By moving the fork 19*a*, the second actuator 19 extends or contracts the arm 8*a*. The fork 19*a* is in sliding contact with the arm 8*a*. To be substantially free from sliding friction resistance, the fork 19*a* contacts the arm 8*a* via balls. This arrangement allows the second actuator 19 to extend and contract the arm 8*a* without rotating together with the winding frame 1.

A third actuator 21 is able to move the driving link 13 relative to the holding link 11 in the directions of the rotational axis. The movement of the driving link 13 is converted into movements of the guide members 7, 8 in the directions of the diameter of the winding frame 1. That is, as the driving link 13 approaches the winding frame 1 from a position indicated in FIG. 4, the angle between the rotating shaft 3 and the converting link 15 decreases and the guide members 7, 8 approach the rotating shaft 3. Conversely, as the driving link 13 moves away from the winding frame 1, the guide members 7, 8 move away from the rotating shaft 3. Thus, a principle similar to that of the framework of an umbrella is applied in this construction.

Thus, the guide members 7, 8 can be moved relative to the winding frame 1 in the directions of the rotational axis and in the directions of the diameter of the winding frame 1 while rotating synchronously with the winding frame 1. The guide members 7, 8 can be moved independently of each other in the directions of the rotational axis while assuming equivalent positions in the directions of the diameter of the winding frame 1. Since the wire winder has an axis-symmetric construction as mentioned above, the total number of guide members provided is four. That is, the guide members are disposed at opposite sides of the winding frame 1 in the directions of the diameter of the winding frame 1 and the directions of the rotational axis, and can be moved relative to the winding frame 1 independently of one another.

In this embodiment, the actuators 17, 19, 21 for operating the link mechanism 9 move their object members only in the directions of the rotational axis of the winding frame 1. Each actuator 17, 19, 21 is able to perform its required function without rotating together with the winding frame 1. Therefore, the actuators 17, 19, 21 are supported by the apparatus base or the like so that they are prevented from rotating.

The right and left-side driving links 13 are moved by the single third actuator 21. A control unit (controller) 23 operates the winding frame-rotating motor 5, the actuators 17, 19, 21, and other actuators or the like. The control unit 23 outputs control signals to the actuators and the like based on signals from sensors provided in the wire winder.

A specific construction of the wire winder will now be described with reference to FIGS. 2 and 3.

Winding frame supports 32 are disposed on opposite side portions of an apparatus base 30. The supports 32 rotatably support the rotating shaft 3 and the winding frame 1. Pulleys 34 are provided on opposite end portions of the rotating shaft 3, and pulleys 40 are provided on opposite end portions of a drive shaft 38 that is provided below the apparatus base 30. The pulley 34 and the pulley 40 on each side are connected by a drive belt 36. The drive shaft 38 is connected to the motor 5 by a belt. Therefore, the winding frame 1 is rotated by the motor 5 driving the pulley 40 via the belt.

Right and left-side guide tables 42 are provided on the apparatus base 30. The guide tables 42 are slidable along rails 44 that are provided on the apparatus base 30, in directions of the rotational axis of the winding frame 1. The right and left-side guide tables 42 are driven independently of each other by motors 46*b* and 46*a*, respectively. The motors 46*a*, 46*b* correspond to the first actuators 17 shown in FIG. 4.

A guide table 42, as a representative of the two symmetrical tables 42, has a guide support 48 fixed thereto. The guide support 48 rotatably supports a holding ring 50 that is disposed coaxially with the rotating shaft 3. The holding ring 50 is restrained relative to the rotating shaft 3 by a driving cylinder 66 (described later) in the rotational directions so that the holding ring 50 rotates synchronously with the rotating shaft 3. The holding ring 50 is also restrained relative to the guide support 48 in the directions of the axis. The holding ring 50 corresponds to the holding link 11 shown in FIG. 4.

The holding ring 50 holds guide tab arms 54, 56 each of which has a guide tab on its distal end. The guide tabs correspond to the guide members 7, 8 shown in FIG. 4. The guide tab arms 54, 56 are mounted on rails 58 of the holding ring 50 in such a manner that the guide tab arms 54, 56 are slidable relative to the holding ring 50 in the directions of diameter of the holding ring 50.

The guide tab arm 56 is extendable and contractable in the directions of the rotational axis, and corresponds to the extendable arm 8*a* shown in FIG. 4. A distal end portion of the guide tab arm 56 is connected to a disc 60. The fork 19*a* of the second actuator 19 fixed to the table 42 clamps the disc 60. The fork 19*a* moves the disc 60 in the direction of the rotational axis so as to extend or contract the guide tab arm 56.

The disc 60 is supported by the holding ring 50, and rotates coaxially and synchronously with the winding frame 1. The disc 60 is connected to the holding ring 50 via extendable arms 61.

The guide tab arm 56 is constructed so that a distal end portion of the guide tab arm 56 is fixed in position relative to the disc 60 in the direction of the rotational axis, but is movable relative to the disc 60 in the directions of the diameter of the disc 60.

A driving cylinder support 62 is mounted on the guide table 42. The support 62 is connected to a rail 64 provided on the guide table 42 so that the driving cylinder support 62 is slidable relative to the guide table 42 in the direction of the rotational axis of the winding frame 1.

The driving cylinder support 62 supports the driving cylinder 66 rotatably. The driving cylinder 66 is disposed coaxially with the rotating shaft 3. The driving cylinder 66 is restrained relative to the rotating shaft 3 in the rotational directions so that the driving cylinder support 62 and the rotating shaft 3 rotate synchronously. The driving cylinder 66 corresponds to the driving link 13 shown in FIG. 4. The driving cylinder 66 is connected to the holding ring 50 via converting members 55. The converting members 55 corresponds to the converting link 15 shown in FIG. 4.

As is understood from the above description, the wire winder shown in FIGS. 2 and 3 has a mechanism illustrated in FIG. 4. Therefore, the wire winder operates as described above with reference to FIG. 4 so that each guide tab is moved relative to the winding frame 1 in the directions of the diameter thereof and in the directions of the rotational axis.

Constructions for moving the driving cylinders 66 on the guide tables 42 will be described with reference to FIG. 3. As shown in FIG. 3, one of the guide tables 42 (left-side table in this embodiment) has a motor 68 fixed thereto. The motor 68 corresponds to the third actuator 21 shown in FIG. 4.

The motor 68 rotates a first shaft 70 that extends parallel to the rotating shaft 3 of the winding frame 1. The first shaft 70 meshes with the driving cylinder support 62 so as to form a ball screw mechanism 72. The driving cylinder support 62 has an inverted-T shape, and a leg portion thereof extending perpendicularly to the rotational axis of the winding frame 1 is engaged with the first shaft 70.

The first shaft 70 extends to the other guide table 42, that is, the right-side table 42. The first shaft 70 is supported by a bearing support 74 of the right-side table.

The right-side table 42 is provided with a second shaft 76 that extends parallel to the first shaft 70. The second shaft 76 is supported by a bearing support 78. The second shaft 76 is engaged with a driving cylinder support 62 so as to form a ball screw mechanism, as is the case with the first shaft 70.

A gear 80 provided on the first shaft 70 and a gear 82 provided on the second shaft 76 are meshed with each other, and the two gears have equal numbers of teeth. Each shaft and the gear thereon are connected by a ball spline mechanism. Therefore, the shafts 70, 76 can be moved relative to the gears 80, 82 in the directions of their rotating axes.

As the motor 68 turns the first shaft 70, the second shaft 76 is also turned the same amount of rotation due to the gears 80, 82. Therefore, due to the ball screw mechanisms, the driving cylinder supports 62 on the right and left-side tables 42 are simultaneously moved in the directions of the rotational axis, so that the driving cylinders 66 are moved relative to the holding rings 50 in the directions of the rotational axis.

Since the first shaft 70 and the second shaft 76 rotate equal amounts in opposite directions, the right and left-side driving cylinders 66 are moved equal distances over the apparatus base in opposite directions. That is, the driving cylinders 66 disposed at the right and left sides of the winding frame 1 simultaneously move toward or away from the winding frame 1.

The shafts 70, 76 and the gears 80, 82 are slidable relative to each other as described above. The sliding of the shafts 70, 76 and the gears 80, 82 occurs when the tables 42 are moved relative to the apparatus base 30. Due to the sliding, the mesh between the gears 80, 82 is maintained even when the tables 42 are moved.

Thus, in this embodiment, the single actuator 68 moves the right and left-side driving cylinders 66 simultaneously by equal amounts in all situations. Therefore, the four guide tabs can be simultaneously moved in the directions of the diameter of the winding frame 1 to position the guide tabs at equal distances from the rotational axis of the winding frame 1. When a conductive wire is wound for each layer of a coil, the four guide tabs contact the winding of the layer and define a wire winding position. These operations are performed by using only one actuator, so that the number of actuators employed in the wire winder is advantageously reduced.

Figure 5:
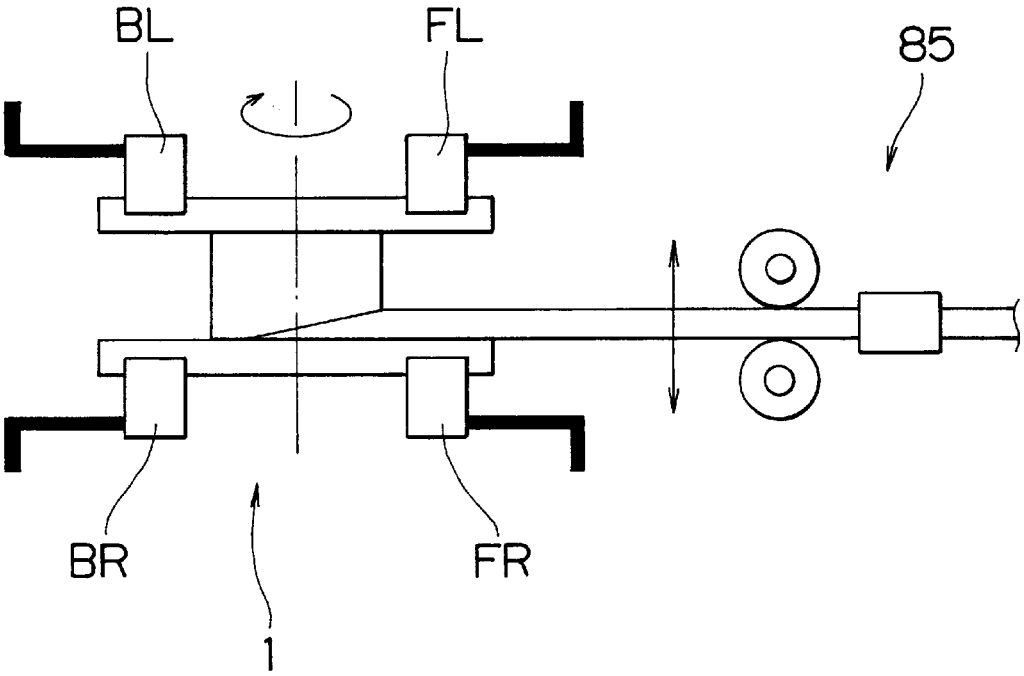
FIG. 5 is a schematic illustration showing a nozzle for supplying a conductive wire to the wire winder shown in FIG. 1.

Next described will be a construction for supplying a conductive wire to the winding frame 1. Referring to the schematic illustration of FIG. 5, four guide tabs BL, BR, FL, FR are disposed near the winding frame 1. These guide tabs correspond to the above-described four guide tabs. The wire is supplied from a nozzle 85 disposed near the winding frame 1. As indicated in FIG. 5, the nozzle 85 is formed by two pairs of rollers disposed perpendicularly to each other. The wire is passed through the gaps between the rollers to the winding frame 1.

The nozzle 85 is disposed so that it is movable relative to the winding frame 1 by an actuator (not shown). Therefore, the nozzle 85 is moved back and forth in the directions of the rotational axis of the winding frame 1. This reciprocation of the nozzle 85 changes the wire-supplying direction so as to shift the wire from one turn of winding to the next turn. That is, in this embodiment, the nozzle 85 and a nozzle driving mechanism (not shown) function as a turn shift driver that causes a turn shift of the wire.

Figure 6:
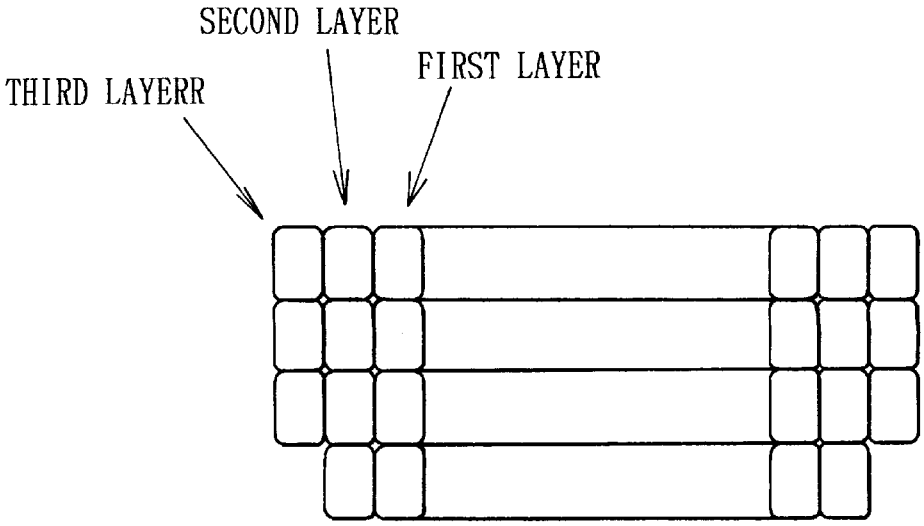
FIG. 6 shows an example of the coil formed by the wire winder shown in FIG. 1.

With reference to FIGS. 6 to 12D, the wire winding operation performed by the wire winder of this embodiment will be described. The wire winding operation will be described in the case of production of a trapezoidal coil as shown in FIG. 6. Coils having other shapes can also be formed in similar manners. In this embodiment, a rectangular conductive wire having a generally rectangular or quadrangular sectional shape is used to form a coil, as shown in FIG. 6.

Figure 7A:
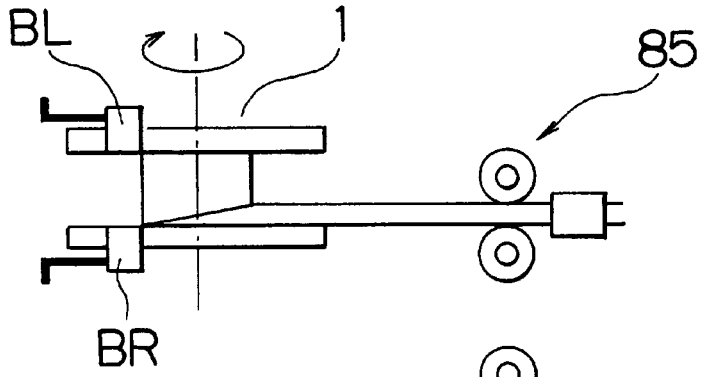
FIGS. 7A, 7B, 7C, 7D, 7E and 7F show a process of winding the first layer of the coil shown in FIG. 6.

FIGS. 7A to 7F illustrate a process of winding a conductive wire in the first layer. First, a leading end portion of the wire is clamped to one of two end flanges of the winding frame 1, as shown in FIG. 7A. At this moment, the guide tabs BL, BR are positioned at the flanges of the winding frame 1, that is, at the ends of the wire winding surface of the winding frame 1. Although the other guide tabs FL, FR are not shown in FIGS. 7A to 7F because they do not function during the winding of the first layer, the guide tabs FL, FR are withdrawn to positions at which the guide tabs FL, FR do not interfere with the wire.

Figure 7B:
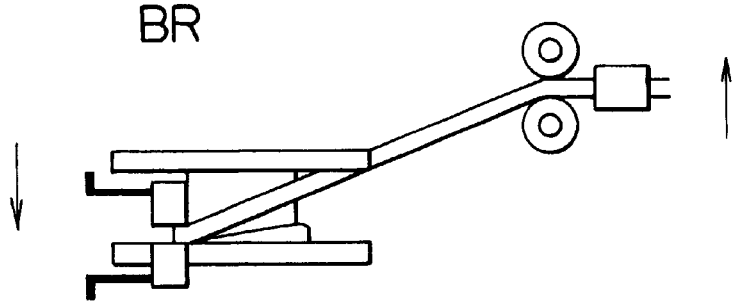

Next, the winding frame 1 starts to rotate so that the wire winding starts, as shown in FIG. 7B. Immediately before one complete rotation of the winding frame 1 (that is, when the winding frame 1 rotates about 270°), the guide tab BL is moved in the direction of the rotational axis of the winding frame 1 to contact a portion of the wire wound on the winding frame 1, at a side of the wire that faces in the direction of the rotational axis, and therefore supports the wire against the adjacent flange. In this step, the nozzle 85 is moved in a direction of the rotational axis, that is, the direction of a shift from the first turn toward the second turn of winding.

Figure 7C:
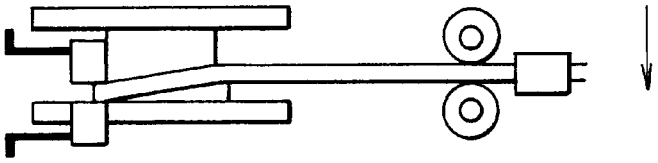

FIG. 7C shows a state in which the winding frame 1 has completed the first rotation. In that state, the nozzle 85 is set to a position corresponding to the second turn of winding after being temporarily moved far away from the position of the second turn and being moved back. That is, the nozzle 85 is shifted from the position indicated in FIG. 7A by an amount corresponding to the width of the wire. Thus, after the winding of the first turn ends, the winding frame 1 continues to rotate, so that the process proceeds to a step of winding the wire for the second turn.

Figure 7D:
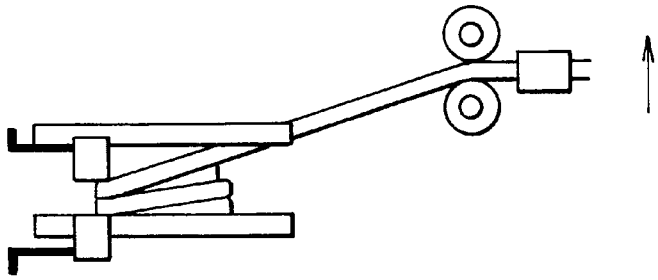
Figure 7E:
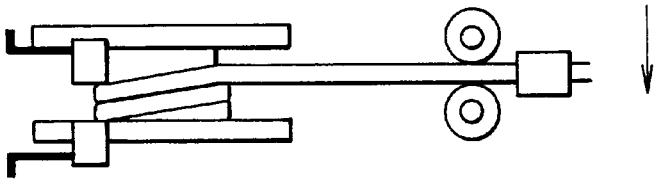

FIGS. 7D and 7E illustrate the step of winding the wire for the second turn. The step is performed in substantially the same manner as the step of winding the wire for the first turn illustrated in FIGS. 7B and 7C.

Figure 8A:
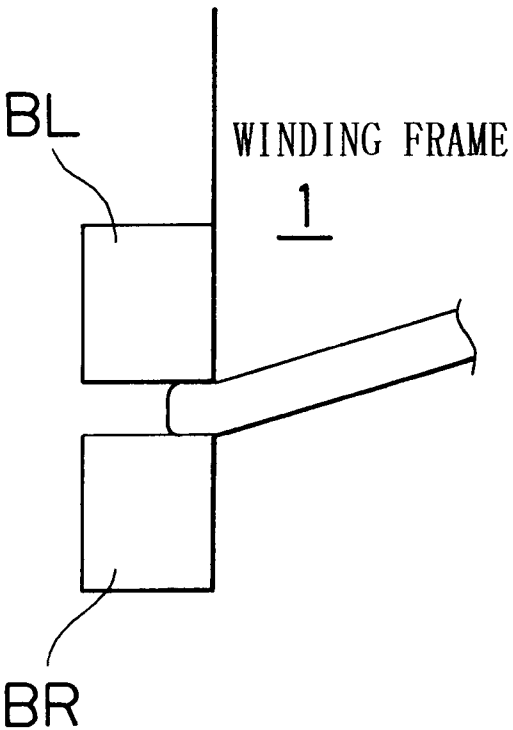
FIGS. 8A, 8B and 8C show a movement of guide tabs while the first turn winding is clamped by guide tabs during the wire winding process.
Figure 8B:
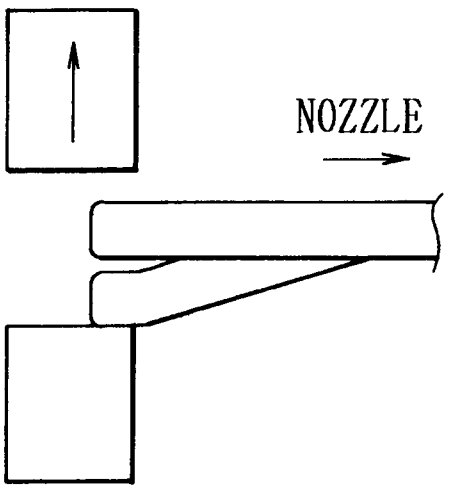
Figure 8C:
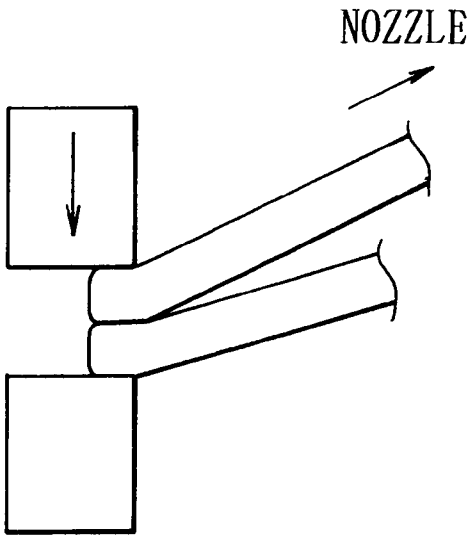

However, as shown in FIGS. 8A to 8C, in order to clamp the wire between the guide tabs BL, BR for the second turn, the guide tab BL is temporarily moved a great distance such that the interval between the guide tabs BL, BR becomes greater than twice the width of the wire. The wire is then received between the two guide tabs BL, BR for the second turn. Then, the interval between the guide tabs BL, BR is reduced so that the first and second turns of winding are clamped between the two guide tabs BL, BR.

The above-described operation of the guide tabs prevents the conductive wire from hooking on a guide tab and prevents the wire from rubbing against a guide tab, thereby preventing a damage to the conductive wire and, in particular, a damage to an insulating coat of the wire.

In the operation illustrated in FIGS. 8A to 8C, after the conductive wire is received between the guide tabs, the guide tabs are brought closer to each other to restrain the winding being formed, from both ends. Therefore, the shape of the coil winding is reliably maintained, and the shape precision of the coil improves.

When the other two guide tabs not shown in FIGS. 7A to 7F clamp the conductive wire, a similar operation is performed.

Figure 7F:
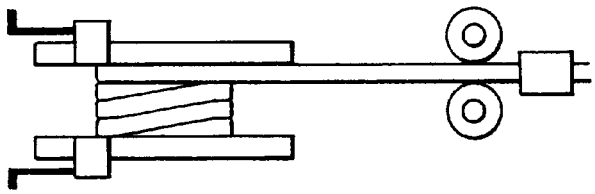

Referring to FIG. 7F, the winding of the first layer is completed after the third and fourth turns are wound in a similar manner.

Figure 9A:
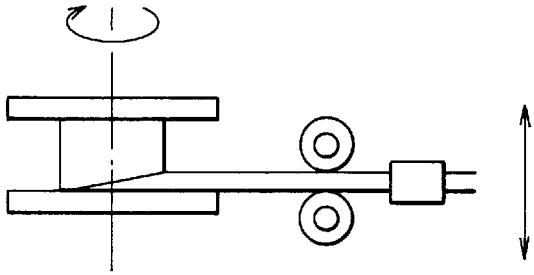
FIGS. 9A, 9B, 9C and 9D show a related-art wire winding process that does not employ a guide tab.
Figure 9B:
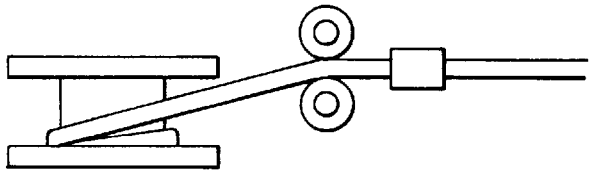
Figure 9C:
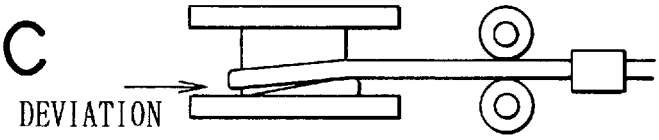
Figure 9D:
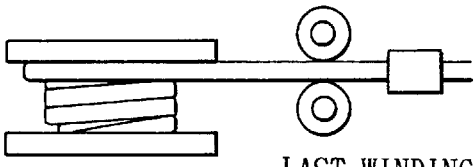

FIGS. 9A to 9D illustrate a process of winding a conductive wire in a case where the guide tabs according to the embodiment of the invention are not provided. In this case, a great tension acts on the conductive wire as the winding frame rotates. When the direction of advancement of winding of the conductive wire on the winding frame is changed for a turn shift, a portion of the wire wound on the winding frame is dragged in a direction of the rotational axis of the winding frame. As a result, that portion of the wound wire deviates in the direction of the rotational axis as indicated in FIG. 9C. Such a deviation of a portion of the wound wire occurs every turn shift, and may add up to a great amount as a whole. Therefore, there is a possibility that the accumulated deviation of windings will make it impossible to wind the last turn as indicated in FIG. 9D.

In the embodiment of the invention, however, the winding position of a conductive wire is restricted by guide tabs, so that the deviation of a wound wire portion as illustrated in FIGS. 9A to 9D is substantially prevented. Therefore, a predetermined number of turns of each layer can be reliably achieved, and the entire coil will be precisely formed into a predetermined shape.

Figure 10A:
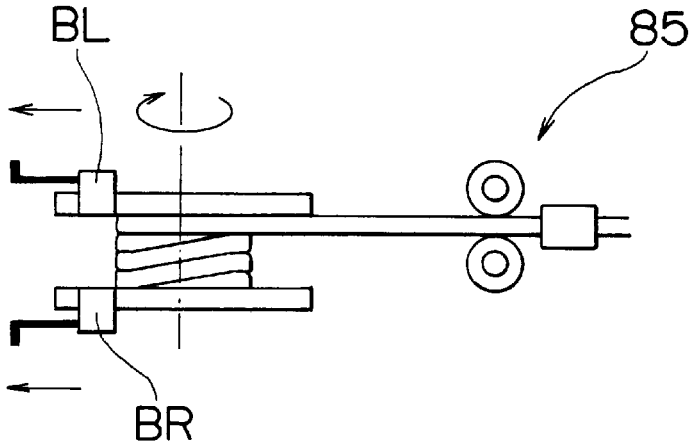
FIGS. 10A, 10B, 10C and 10D show a process of winding the second layer.

A winding process for the second layer will be described with reference to FIGS. 10A to 10D. As indicated in FIG. 10A, the guide tabs BL, BR are moved a distance corresponding to the thickness of the wire away from the rotational axis of the winding frame. That is, the two guide tabs are moved equal distances away from the rotational axis by operating a single actuator as described above. While this state is maintained, the winding frame is rotated substantially 360° to wind the first turn of the second layer.

Figure 10B:
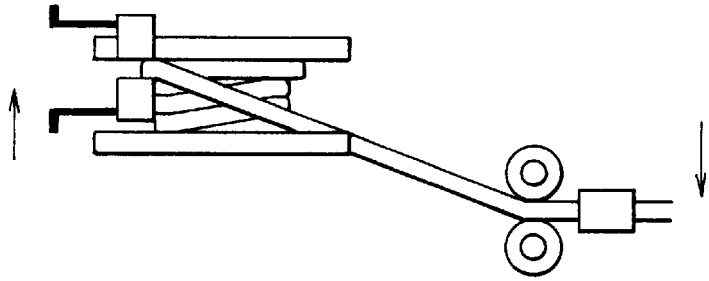
Figure 10C:
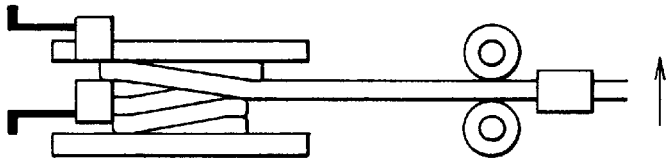
Figure 10D:
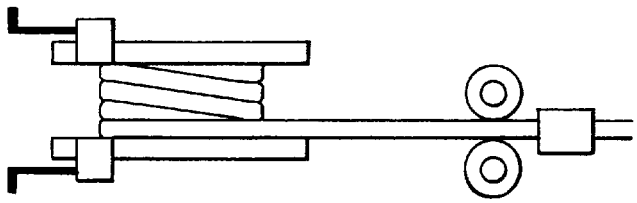

FIGS. 10B and 10C show steps of shifting the wire from the first turn to the second turn. This turn shift operation is performed in substantially the same manner as in the first layer (FIGS. 9B and 9C), but in the opposite direction. That is, immediately before one complete rotation of the winding frame (that is, when the winding frame rotates about 270°), the guide tab BR is moved in the direction of the rotational axis of the winding frame to contact a portion of the wire wound on the winding frame, at a side of the wire that faces in the direction of the rotational axis, and therefore presses the wire against the adjacent flange. After that, the nozzle is moved a great distance in the direction of the rotational axis, and then moved in the opposite direction to a position corresponding to the second turn. FIG. 10C shows a state in which the winding frame has completed one rotation from the state shown in FIG. 10A. In the state shown in FIG. 10C, the turn shift to the second turn is completed. Similar winding steps are performed for the third and fourth turns so as to complete the winding of the second layer (FIG. 10D).

Winding steps for the third layer will be described with reference to FIGS. 11A to 11D. These drawings illustrate the formation of a trapezoidal coil in which the number of turns in the third layer is three, that is, less than the number of turns (i.e., four) in each of the first and second layers. Due to the decreased number of turns, the third layer is formed in a different manner as described below.

Figure 11A:
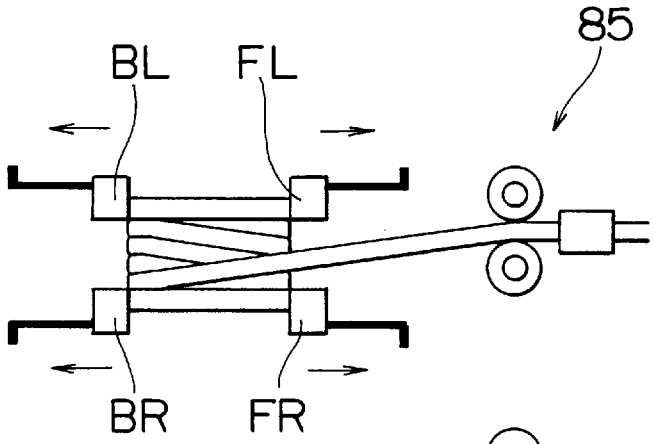
FIGS. 11A, 11B, 11C and 11D shows a process of winding the third layer of the coil.

FIG. 11A shows a state assumed at the start of the third layer winding. During the winding of the third layer, the four guide tabs BL, BR, FL, FR function. All the guide tabs are positioned at the flanges of the winding frame. Each guide tab is moved a distance corresponding to the thickness of the wire from the position assumed at the end of the winding of the second layer, in a direction away from the rotational axis of the winding frame. As mentioned above, all the guide tabs are moved equal distances away from the rotational axis by the single actuator. The nozzle is shifted about a distance corresponding to the width of the wire in a direction of the rotational axis, so that the number of turns in the third layer becomes less than the number of turns in the second layer and, therefore, the coil will have a trapezoidal shape.

The wire winding for the third layer starts with rotation of the winding frame from the state shown in FIG. 11A. Although not shown in the drawings, the guide tab FR is moved in the direction of the rotational axis to contact the conductive wire when the winding frame rotates about 90°.

Figure 11B:
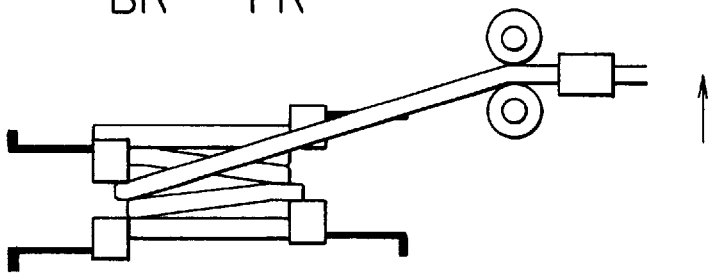

When the winding frame rotates about 270° as shown in FIG. 11B, the guide tab BL is moved in the direction of the rotational axis to contact the conductive wire. In this step, the nozzle is moved a great distance in the direction of the rotational axis for a turn shift to the second turn.

Figure 11C:
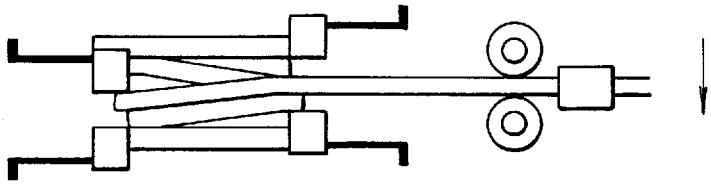
Figure 11D:
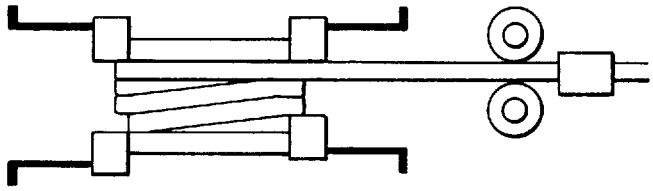

FIG. 11C shows a state in which the frame winding has completed one rotation. The guide tabs FR, BL remain in contact with the wire after being brought into the contact during the winding of the first turn as described above. The nozzle is set at a position corresponding to the second turn after being moved a great distance in the direction of the rotational axis and being moved back in the opposite direction. As a result of the two-way movements of the nozzle, the turn shift to the second turn is completed.

As shown in FIGS. 11B and 11C, the guide tabs FR, BL define a winding position of the wire such that the wire is wound in the position of the first turn in the third layer (directly over the third turn in the second layer). The provision of the guide tab FR makes it possible to precisely form a stepped portion corresponding to the difference in number of turns (i.e., one turn) between the second layer and the third layer and therefore precisely form a predetermined trapezoidal shape of the coil. That is, the guide tab FR prevents an undesired event that the winding of the first turn in the third layer deviates toward the nearby end portion (flange) of the winding frame and results in a disturbed configuration of the coil. The guide tab BL functions to effectively prevent the winding from deviating in the direction of the turn shift of the wire, as in the other layers.

The winding of the second and third turns of the third layer is performed in substantially the same manner as in the first layer, except that the winding restraint provided by the guide tab FR shown in FIGS. 11B and 11C is maintained. As a result of the winding operation described above, a trapezoidal coil as shown in FIG. 11 is formed.

Figure 12A:
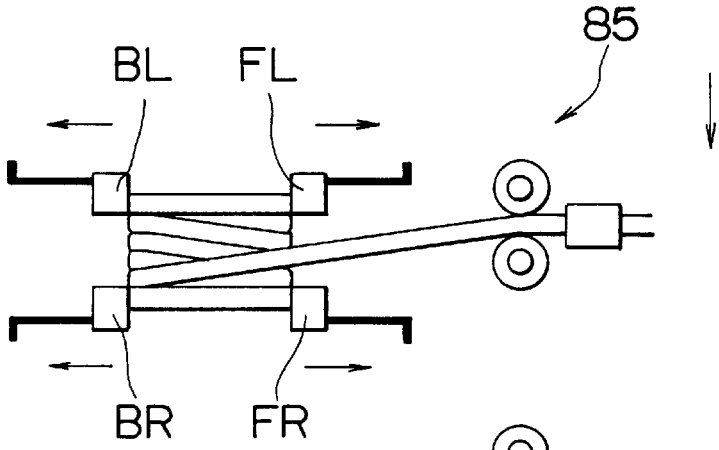
FIGS. 12A, 12B, 12C and 12D show a modified process of winding the third layer.
Figure 12B:
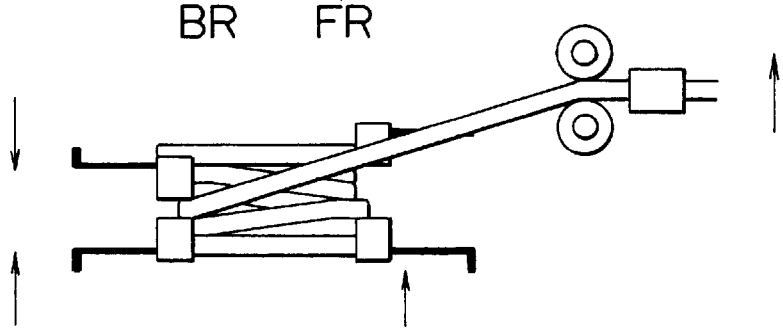
Figure 12C:
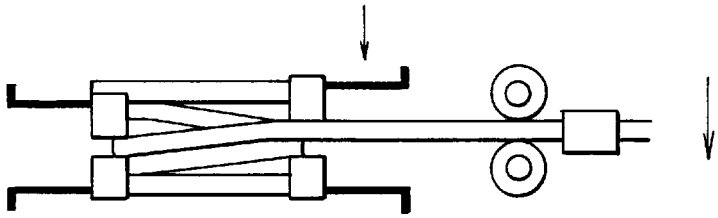

FIGS. 12A to 12D illustrate a modification of the third-layer winding process. As shown in FIG. 12B, the guide tab BR is in contact with the first turn winding of the third layer, at a side of the winding that faces in the direction of the rotational axis. The guide tab BR is moved immediately before the winding frame turns one rotation (when the winding frame turns about 270°). The winding is clamped between the guide tab BR and the guide tab BL, so that the winding is reliably held at the predetermined winding position. The guide tab BR and the guide tab FR support the winding from the winding frame flange-side. Therefore, a stepped portion of the trapezoidal coil (corresponding to the difference in number of turns between the second and third layers) is further reliably formed.

Furthermore, in the wire winding process illustrated in FIGS. 12A to 12D, the guide tab FL is also moved in the direction of the rotational axis to contact the conductive wire. The guide tab FL and the guide tab FR restrain windings from the opposite sides. The guide tab FL is shifted in position in the direction of the rotational axis (withdrawn a distance corresponding to the width of the wire) every time the winding frame turns one rotation. When receiving the winding of a new turn, the interval between the guide tabs is expanded so as to prevent interference of a guide tab with the wire and therefore prevent a damage to the wire, as described above with reference to FIGS. 8A to 8C.

In the winding process illustrated in FIGS. 12A to 12D, the winding position of the wire is defined by simultaneously using the four guide tabs. Therefore, the deviation of a winding is more reliably prevented, and the completed coil will have a further stable configuration.

The coil winding operation is performed as described above. Although the operation is described above in conjunction with the formation of a trapezoidal coil as shown in FIG. 6, the wire winder of this embodiment is also able to form coils having other configurations, for example, a coil having a different number of layers and a different number of turns in each layer, a coil in which arbitrary numbers of turns are set for the individual layers, a coil having a generally rectangular sectional shape, and the like.

In this embodiment, the guide tabs rotate synchronously with the winding frame. Therefore, the movements of the guide tabs and the definition of the wire winding position by the guide tabs as described above are performed while the winding frame continues rotating.

Figure 12D:
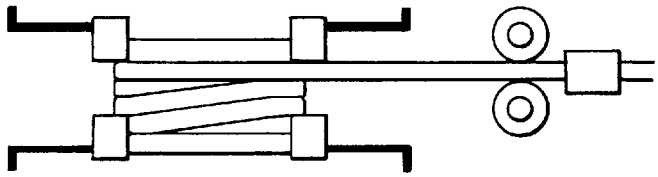
Figure 13A:
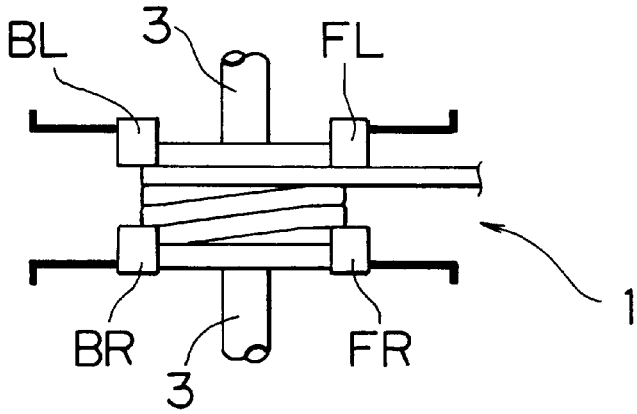
FIGS. 13A, 13B, 13C and 13D illustrate a process of removing a completed coil from the winding frame, showing a state similar to that shown in FIG. 12D, in which the wire winding is completed.

An operation of removing a completed coil from the winding frame will be described with reference to FIGS. 13A to 13D. FIG. 13A, similar to FIG. 12D, shows a state in which a coil is completed.

Figure 13B:
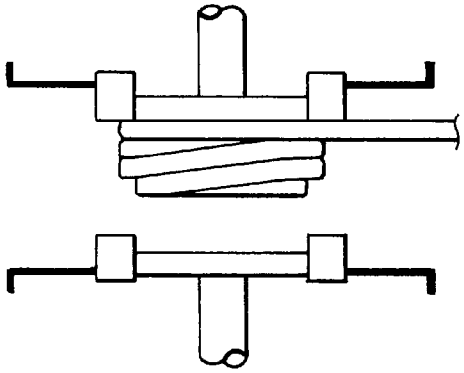

As shown in FIG. 13B, the winding frame 1 is first separated into two parts. The winding frame 1 is constructed so as to be separable into a wire winding part and flange parts. In FIG. 13B, one of the flange parts is separated from the wire winding part. In the step illustrated in FIG. 13B, the two guide tabs BR, FR are moved together with the flange part of the winding frame 1.

More specifically, rotation shafts are connected to the opposite ends of the winding frame 1 in this embodiment, as shown in FIGS. 2 and 3. The rotation shafts are movable in the directions of the rotational axis by actuators (not shown). One of the rotation shafts is moved in a direction of the rotational axis, so that the flange connected to that shaft is withdrawn to separate from the wire winding part of the winding frame 1.

Figure 13C:
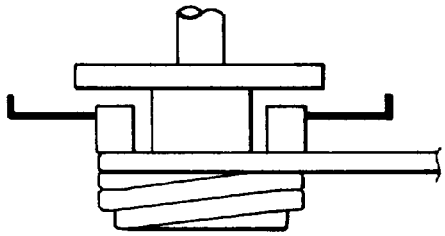

After that, the guide tabs BL, FL are simultaneously moved in the direction of the rotational axis to push the coil out from the winding frame 1. Preferably, the guide tabs BL, FL are moved closer to the rotational axis as shown in FIG. 13C before they push the coil, so that the guide tabs contact increased areas in the end surface of the coil and therefore the coil is more reliably kept in shape.

Figure 13D:
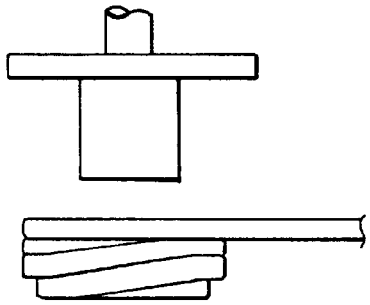

When the coil completely comes off from the wire winding part of the winding frame 1 as shown in FIG. 13D, an operating person removes the coil. The coil may also be removed by an automatic conveying apparatus or the like.

As a modification of the above-described operation, the four guide tabs may clamp the coil from the opposite sides when the coil is removed from the winding frame in the direction of the rotational axis, so that the coil is more reliably prevented from losing its shape.

A device that automatically clamps a leading end portion of a conductive wire on the winding frame at the start of the wire winding operation will be described with reference to FIGS. 14A to 14C and FIGS. 15A to 15C.

Figure 14C:
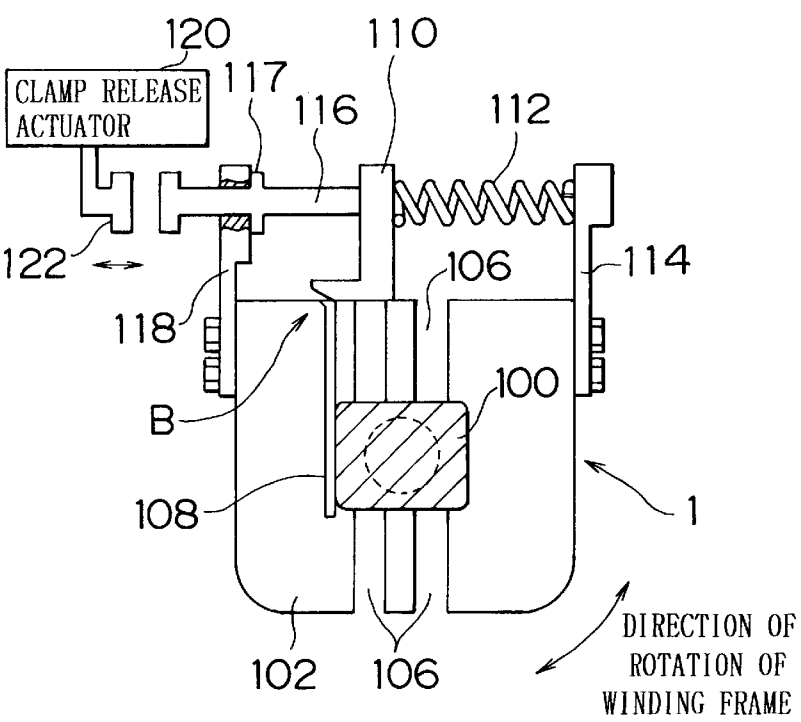
FIG. 14C is a sectional view of the winding frame shown in FIG. 14A, taken on line 14C–14C.
Figure 14B:
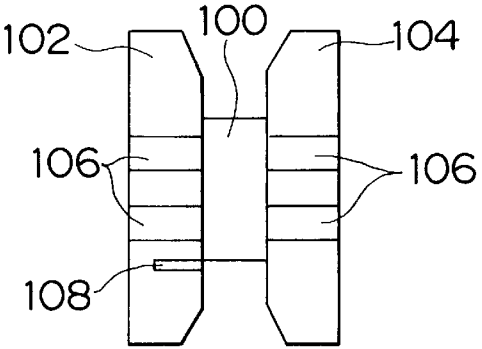
FIG. 14B is a view of the clamp device shown in FIG. 14A, taken in another direction.
Figure 14A:
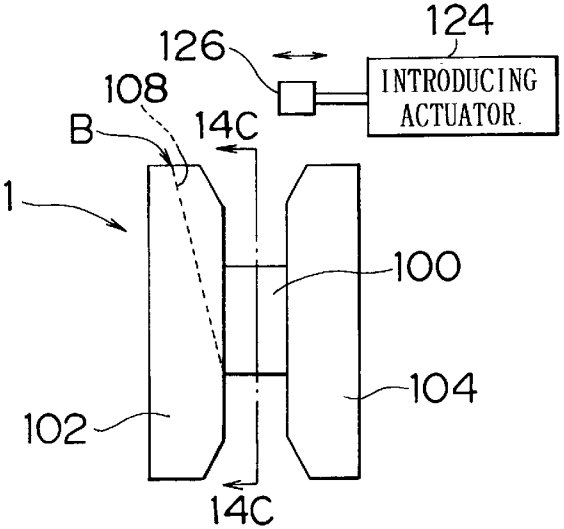
FIG. 14A is views of a device for automatically clamping a leading end portion of a conductive wire to a winding frame, taken in a certain direction.

FIGS. 14A to 14C are enlarged views of the winding frame 1 taken in three directions. FIG. 14C is a sectional view of the winding frame 1 taken on line 14C—14C in FIG. 14A. The winding frame 1 has a wire winding part 100 on which a conductive wire is wound. The wire winding part 100 has a shape corresponding to the shape of a coil to be formed, that is, has a shape substantially the same as the shape of a magnetic pole of a motor to which the coil is to be attached.

The winding frame 1 has frame flanges 102, 104 that are connected to opposite sides of the wire winding part 100. The frame flanges 102, 104 contact and support opposite end surfaces of a coil being formed, and thereby prevent the coil from losing its shape. Each frame flange 102, 104 has escape portions 106 that are formed by cutouts for avoiding interference of the frame flange with the guide tabs provided for defining the winding position of the conductive wire. The four guide tabs pass through the escape portions 106 to contact the wire wound on the wire winding part 100.

One of the frame flanges 102, 104, that is, a frame flange 102, has a guide groove 108 for guiding a leading end portion of the conductive wire to a clamp position B. As shown in FIG. 14C, the guide groove 108 extends from a portion of the wire winding part 100 near one of the four corners of the wire winding part 100, and extends along a side of the wire winding part 100 to the clamp position B in an upper end of the frame flange 102. The guide groove 108 gradually becomes deeper with increases in the distance from the starting point of the guide groove 108, so that the guide groove 108 becomes deepest at the clamp position B.

As shown in FIG. 14C, a clamp tab 110 is provided on the upper end of the frame flange 102 in such a manner that the clamp tab 110 is movable along the upper end of the frame flange 102. A distal end of the clamp tab 110 is positioned at the clamp position B (the outlet of the guide groove 108). A distal end portion of the clamp tab 110 and the upper end of the frame flange 102 form a wedge-shaped gap therebetween as shown in FIG. 14C. Therefore, when the clamp tab 110 pushes a portion of the wire protruded from the guide groove 108, the protruded portion is bent in the pushing direction, as described below.

A coil-type clamp spring (return spring) 112 is connected at one end thereof to the clamp tab 110. The other end of the clamp spring 112 is connected to a support arm 114 that is fixed to the frame flange 102 with bolts. The clamp spring 112 urges the clamp tab 110 toward the clamp position B (the outlet of the guide groove 108).

A release rod 116 is connected to a side of the clamp tab 110 remote from the clamp spring 112. The release rod 116 is disposed coaxially with the clamp spring 112, and extends parallel to the upper end of the frame flange 102. The release rod 116 is supported by a rod support arm 118. The rod support arm 118 is fixed to an end surface of the frame flange 102 remote from the support arm 114 supporting the clamp spring 112. The release rod 116 extends through a through hole that is formed in the rod support arm 118. The release rod 116 is movable in the through hole of the rod support arm 118. A stopper protrusion 117 of the release rod 116 contacts a wall surface of the rod support arm 118. The stopper protrusion 117 defines the movable range of the release rod 116.

A clamp release actuator 120 is fixed relative to the apparatus base (not shown). The clamp release actuator 120 is able to push the release rod 116. When a push arm 122 of the clamp release actuator 120 is moved to the right (in FIG. 14C) to push the release rod 116, the clamp tab 110 is moved against the force from the clamp spring 112, and therefore is moved away from the clamp position B. When the clamp release actuator 120 returns the push arm 122, the clamp tab 110 is pushed back to the clamp position B by the clamp spring 112.

As shown in FIG. 14A, an introducing actuator 124 is provided near the winding frame 1. The introducing actuator 124 has an introducing arm 126 that is movable in the directions of the rotational axis of the winding frame 1. By advancing and withdrawing the introducing arm 126, the introducing actuator 124 guides a leading end portion of the conductive wire supplied from a nozzle (not shown).

The operation of the clamp device will be described with reference to FIGS. 15A to 15C.

Figure 15A:
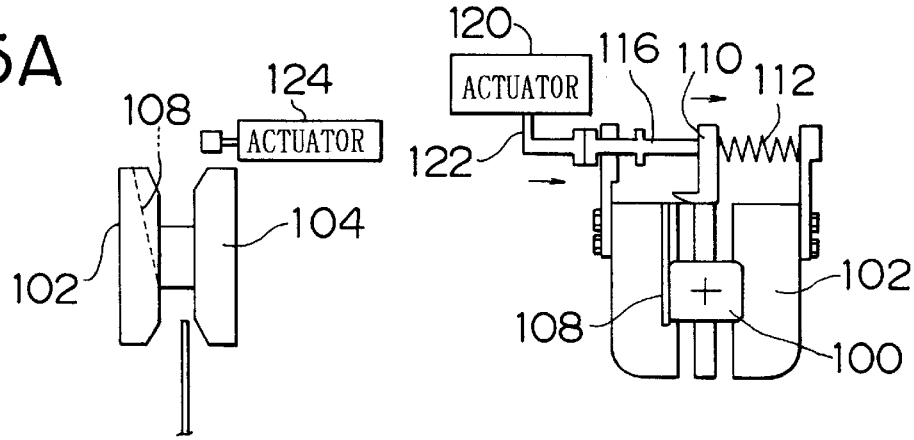
FIGS. 15A, 15B, 15C show the operation of the clamp device shown in FIGS. 14A to 14C.

First, as shown in FIG. 15A, the clamp release actuator 120 moves the push arm 122 to push the release rod 116 so that the clamp tab 110 is moved against the resisting force from the clamp spring 112. Therefore, the outlet of the guide groove 108 becomes open.

Figure 15B:
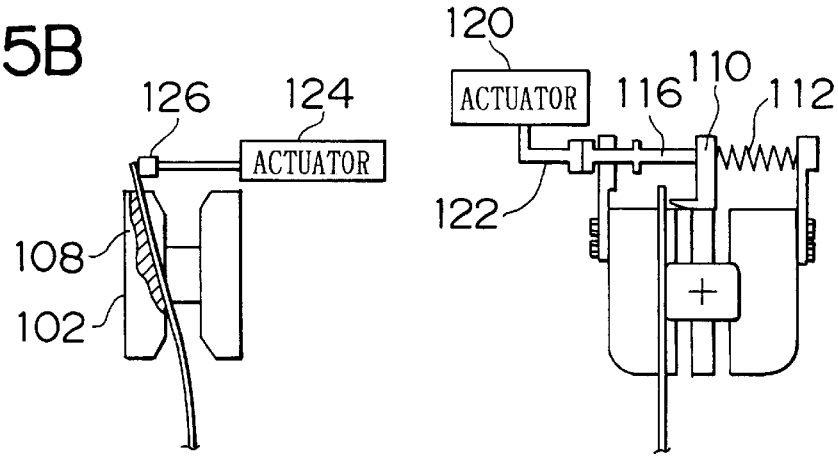

Next, as shown in FIG. 15B, the conductive wire is fed from the nozzle, and the introducing actuator 124 moves the introducing arm 126 toward the frame flange 102. Therefore, the leading end of the wire enters the guide groove 108, and advances in the guide groove 108. Since the wire is pressed by the introducing arm 126, the wire advances along a bottom portion of the guide groove 108. The wire is fed in from the nozzle until a predetermined-length leading end portion of the wire protrudes from the outlet of the guide groove 108.

Figure 15C:
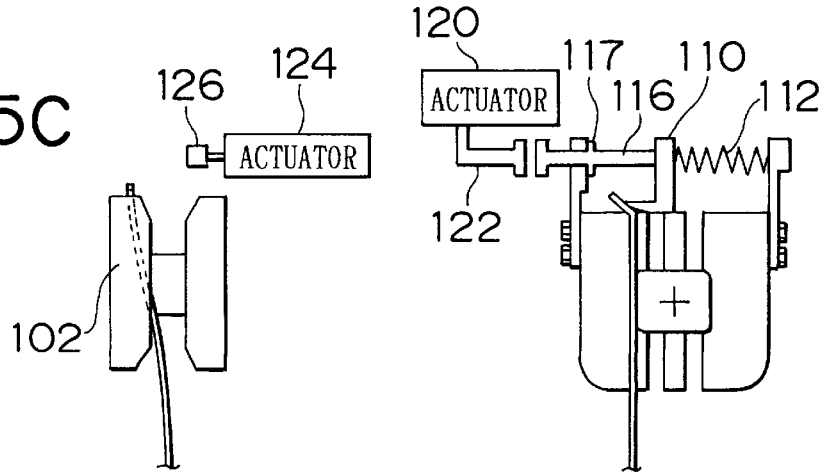

Then, as shown in FIG. 15C, the clamp release actuator 120 withdraws the push arm 122, so that the release rod 116 is pushed by the clamp spring 112 to follow the push arm 122. The release rod 116 stops when the stopper protrusion 117 of the release rod 116 contacts the rod support arm 118. The push arm 122 is withdrawn to a position at which the push arm 122 is apart from the release rod 116.

As the clamp tab 110 is pushed by the clamp spring 112, the clamp tab 110 bends the leading end portion of the wire protruded from the guide groove 108 and presses a bent portion against the frame flange 102. Thus, the bent portion of the wire is clamped between the clamp tab 110 and the frame flange 102.

Thus, the leading end portion of the conductive wire is automatically clamped. After that, the winding frame is rotated to wind the wire. When the wire winding operation to form a coil ends, the clamp release actuator 120 is operated to move the clamp tab 110, so that the clamped state discontinues and the coil can be removed.

In this embodiment, the leading end portion of the conductive wire is bent along the end portion of the frame flange and clamped by the clamp tab 110. That is, the leading end portion is bent in the frame turning direction when it is clamped. Therefore, the leading end portion of the wire can be firmly clamped, as described below.

When a wire is wound around a winding frame, a great tension acts on the wire, so that the wire may fall off from the winding frame. In the embodiment, however, since the conductive wire is retained to the winding frame with the leading end portion of the wire bent in the frame turning direction, it is possible to effectively withstand the tension acting on the wire. Thus, the embodiment ensures that the clamped state is maintained.

With regard to the clamping construction, the frame turning direction means the rotational directions about the rotational axis of the winding frame, that is, both the clockwise and counterclockwise directions. In other words, the frame turning direction includes the direction in which the winding frame actually rotates to form a coil, and the opposite rotational direction. Therefore, the direction of bending a leading end portion of the wire for clamping may be either rotational direction.

More specifically, in the illustration shown in FIG. 14C, the winding frame 1 rotates clockwise to form a coil. The clamp tab 110 bends the wire in the counterclockwise direction. In a modification, the wire may be bent in the clockwise direction, that is, in the same direction as the direction of rotation of the winding frame 1. In that case, the clamp tab is positioned on a side of a guide groove opposite to the side shown in FIG. 14C, and other related arrangements and portions are provided symmetrically opposite to those shown in FIG. 14C.

The preferred wire winder of the embodiment is described above. Various advantages of the wire winder of the embodiment will be stated below.

In this embodiment, the guide tabs rotate synchronously with the winding frame. Therefore, it is possible to move the guide tabs while the winding frame continues to rotate. That is, the wire winder eliminates the need to stop the winding frame and move guide tabs during stoppage of the winding frame for every turn shift. The productivity thus improves. Furthermore, the guide tabs can continue supporting the wire even during rotation of the winding frame, so that the coil shape precision improves. In this respect, too, the productivity improves.

According to the embodiment, in particular, the link mechanism supporting the guide tabs has a construction similar to an umbrella framework as shown in FIG. 4.

Therefore, the guide tabs can be moved away from or closer to the rotational axis of the winding frame simply by the third actuator 21 moving the driving link 13 in the directions of the rotational axis of the winding frame. This function can be performed by the third actuator 21 even if the third actuator 21 does not rotate together with the winding frame. Therefore, the third actuator 21 is fixed to the guide table 42, so that the third actuator 21 does not rotate together with the winding frame 1. Thus, the number of actuators to be installed in the rotating section of the apparatus is reduced, so that the apparatus construction is correspondingly simplified. Furthermore, since the weight of the rotating section is also reduced, the load on the winding frame-rotating motor decreases, so that the motor can be reduced in size.

In this embodiment, each guide tab-supporting link mechanism is substantially made up of the holding link 11, the driving link 13, and the converting link 15 as shown in FIG. 4. Thus, it is possible to move the guide tabs in desired manners while employing only a small number of link members. Therefore, the construction is correspondingly simplified.

Still further, in the embodiment, the cylindrical portion of the driving link 13 is inserted in the cylindrical portion of the holding link 11, and the rotating shaft 3 of the winding frame 1 is inserted in the cylindrical portion of the driving link 13 as shown in FIG. 4. Therefore, the apparatus construction is simple, and can be reduced in size. In a modified construction, the cylindrical portion of a holding link may be disposed inwardly of the cylindrical portion of a driving link. This construction also achieves similar advantages.

Further, as indicated in FIG. 4, the guide tabs are moved in the directions of the rotational axis of the winding frame 1 by the first actuator 17 moving the holding link 11 in the directions of the rotational axis in this embodiment. It is possible for the first actuator 17 to perform the function without rotating together with the winding frame 1. Therefore, the first actuator 17 is fixed to the apparatus base. Thus, since the actuator is not disposed in a rotating mechanism, the apparatus construction becomes simple, and the load on the winding frame-rotating motor is reduced.

Still further, as shown in FIG. 3, the guide tabs disposed at the right and left sides of the winding frame 1 are moved in the directions of the diameter of the winding frame 1 by a single motor in this embodiment. That is, it is not necessary to provide actuators separately for the right-side guide tabs and the left-side guide tabs. Therefore, the number of actuators to be provided in the apparatus is reduced.

Further, as indicated in FIGS. 2 and 3, the guide tabs disposed at opposite sides of the rotational axis of the winding frame 1 are movable in the directions of the rotational axis independently of each other in this embodiment. The independent movements of the individual guide tabs are achieved by the discs 60, that is, parts of the link mechanisms, and the second actuators 19 for moving the corresponding discs 60 while remaining in contact with the discs. The actuators 19 are fixed to the apparatus table. Thus, since the actuators do not need to be disposed in rotating mechanisms, the apparatus construction becomes simple, and the load on the winding frame-rotating motor is reduced.

In a related-art wire winder, a press-forming unit has a press jig having a shape corresponding to a turn-shift portion of a coil. If a variety of coils are to be produced by using a single wire winder, it is necessary to prepare various press jigs separately for each kind of coil, and to replace an existing jig with a jig suitable to the kind of a coil to be produced. Furthermore, when a coil is produced, it is necessary to replace a jig with another in accordance with the shape of a turn-shift portion.

To solve these problems of the related art, the embodiment is designed to easily produce a coil without a need to perform the replacement of a jig, or the like.

The guide tabs FL, FR shown in FIGS. 11A to 11D correspond to a first guide member and to a second guide member according to the invention. The guide tabs FL, FR contact sides of windings that are opposite to each other in the direction of the turn shift, at sites forward of the turn-shift portion of the coil in the direction of advancement of winding on the winding frame. The guide tabs BL, BR correspond to a third guide member and to a fourth guide member according to the invention. The guide tabs BL, BR contact opposite sides of windings in the direction of the turn shift, at sites rearward of the turn-shift portion of the coil in the direction of advancement of winding.

The four guide tabs support the wire being wound, from the opposite sides thereof, at the sites forward and rearward of the turn-shift portion of the windings. The guide tabs define the winding position of the wire, and therefore prevent the wire from deviating in position, and enable the turn-shift portion to be formed into a predetermined shape.

The four guide tabs are supported by the link mechanisms shown in FIG. 4, in such a manner that the guide tabs are independently movable in the directions of the rotational axis of the winding frame. Therefore, the guide tabs are able to cope with various turn-shift portions having different shapes.

For example, when a coil as shown in FIG. 6 is to be produced, the turnshift direction in the second layer of the coil becomes opposite to that in the first layer. Furthermore, as shown in FIGS. 11A to 11D, the shape of a turn-shift portion in a stepped portion of the trapezoidal coil is different from the shapes of turn-shift portions in other portions of the coil, because a turn-shift is performed simultaneously with the transition from the second layer to the third layer. In this embodiment, such a plurality of kinds of turn-shift portions can be formed by using the four guide tabs.

In the aforementioned case, a single coil has turn-shift portions of different shapes. The shape of a turn-shift portion also varies depending on the shape, kind or the like of a coil to be formed. For example, the shape of a turn shift portion varies depending on the dimensions of a section of a conductive wire used. The wire winder of this embodiment is able to cope with the turn-shift portions of such various kinds of coils.

As is apparent from the above description, this embodiment makes it possible to form plural kinds of turn-shift portions without a need to replace a jig or the like. Thus, the productivity can be improved.

Furthermore, as shown in FIGS. 6 to 12D, the guide tabs prevent the wire from deviating when the nozzle 85 changes the wire supplying direction to cause a turn shift. This function of the guide tabs in this embodiment achieves a stable shape of the turn-shift portion. In this respect, too, the productivity can be improved.

Furthermore, as described above with reference to FIGS. 8A to 8C, during the process of clamping one or more windings of the wire between guide tabs, the interval between the guide tabs is temporarily expanded to become greater than the width of the winding or windings to be clamped before a new winding is received between the guide tabs. This operation prevents contact between the wire and a guide tab and therefore prevents a damage to the wire and, in particular, a damage to the insulating coating of the wire.

Furthermore, as described above with reference to FIGS. 8A to 8C and the like, the guide tabs disposed at opposite sides of the winding frame restrain opposite ends of the coil windings being formed. Therefore, positional deviation of the windings is reliably prevented, and the configuration of the coil becomes stable.

Further, as described above with reference to FIGS. 13A to 13D, when the wire winding is completed, the coil is removed from the winding frame by the guide tabs moving the coil in the direction of the rotational axis of the winding frame. Therefore, the amount of manual operation needed to remove a coil from the winding frame is reduced, so that the coil producing operation becomes easier. Moreover, since a coil can be removed from the winding frame without employing a dedicated actuator, the apparatus construction becomes correspondingly simple.

A second preferred embodiment of the invention will now be described. This embodiment is a modification of the first embodiment. Therefore, descriptions regarding the second embodiment substantially the same as those made regarding the first embodiment will not be made again below.

In a wire winder according to the second embodiment of the invention, two guide members disposed forward and rearward of a turn-shift portion of windings in the direction of advancement of winding are driven independently of each other. That is, as indicated in FIG. 4, the guide members 7, 8 are moved independently in the directions of the rotational axis of the winding frame, and therefore create a difference in the level (or position) in the direction of the rotational axis of the winding frame. For the independent driving of the two guide members, the guide member 8 is provided with the extendable arm 8*a*, and the second actuator 19 for extending and contracting the arm 8*a*. The second actuator 19, also shown in FIG. 3, is formed by, for example, a cylinder-type actuator. The second actuator 19 is controlled so as to operate in cooperation with the motor 5, which corresponds to a winding frame-rotating actuator. This control is intended to synchronize the operation of the guide member with the rotation of the winding frame.

In order to improve the productivity of coils, it is desired to reduce the time needed to form a coil. To reduce the time, increasing the rotating speed of the winding frame 1 is effective. However, if the winding frame 1 is rotated at a relatively high speed, it becomes difficult for the second actuator 19 to follow the rotation of the winding frame 1.

In order to improve the ability of the actuator to follow the rotation of the winding frame, it may be conceivable to apply a servo (NC) shaft instead of the cylinder-type actuator. However, that type of actuator is expensive, and the production cost will increase.

Figure 16:
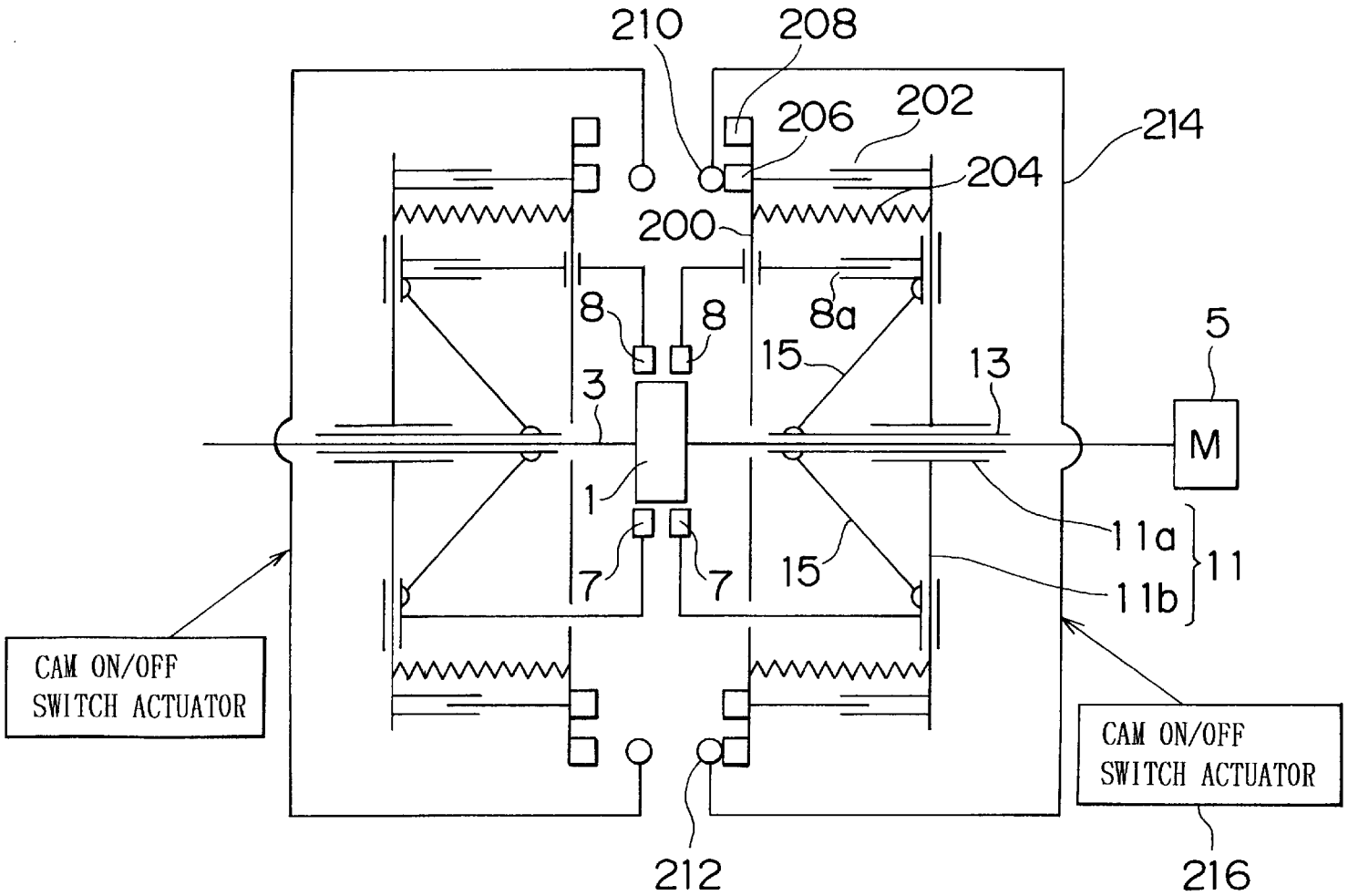
FIG. 16 shows a mechanism of a wire winder according to a second embodiment of the invention.

In view of the aforementioned circumstances, this embodiment is intended to ensure that the guide members operate in cooperation with the rotation of the winding frame. To achieve this object, the guide members are driven by using a mechanical-element mechanism that mechanically converts a torque of the winding frame and uses the converted force, instead of using the cylinder-type actuators. More specifically, the guide members are connected to cams that turn together with the winding frame, as shown in FIG. 16. Using the cams, the guide members are caused to operate in a desired manner. This cam mechanism will be described in detail below.

FIG. 16 shows a mechanism of the wire winder of this embodiment, in which arrangements and portions comparable to those shown in FIG. 4 are denoted by comparable reference characters. Arrangements and portions that are not shown in FIG. 4 will mainly be described below. Since the wire winder shown in FIG. 16 has a symmetric construction, a right-side half construction will mainly be described.

Referring to FIG. 16, an annular cam disc 200 is provided so as to rotate together with a winding frame 1. The cam disc 200 is connected to a holding link 11 by a plurality of extendable arms 202. Since the holding link 11 rotates together with the winding frame 1, the cam disc 200 also rotates together with winding frame 1. The cam disc 200 is urged by springs 204 in a direction away from the holding link 11, that is, a direction toward the winding frame 1.

A guide member 8 is connected to a portion of the cam disc 200 that is adjacent to a distal end of an extendable arm 8*a*. As the cam disc 200 is moved in the direction of the rotational axis, the guide member 8 is moved together with the cam disc 200. The extendable arm 8*a* is constructed so that when the cam disc 200 comes closest to the winding frame 1, that is, when the arm 8*a* is extended to its maximum limit, the guide member 8 comes to a position that is equivalent to the position of a guide member 7 in the direction of the rotational axis. The guide member 8 is slidable relative to the cam disc 200, in the directions of the diameter of the cam disc 200. The guide member 7 is provided so as not to contact the cam disc 200.

An annular first ring cam 206 and an annular second ring cam 208 are provided on a side surface of the cam disc 200, extending along an outer periphery of the cam disc 200. The first ring cam 206 contacts a first cam follower 210. The second ring cam 208 contacts a second cam follower 212. The two cam followers 210, 212 are connected to a cam follower support arm 214. The cam follower support arm 214 and the cam followers 210, 212 are prevented from rotating.

The cam follower support arm 214 is moved in the directions of the rotational axis by a cam on/off switching actuator 216. A right-side half portion of the illustration of FIG. 16 shows a state in which the cam follower support arm 214 has been moved to the right by the cam on/off switching actuator 216 so that the cams are in contact with the cam followers. In this state, the cams function (a cam operating state, or an effective state). In the left-side half portion of the illustration of FIG. 16, the cam follower support arm 214 is positioned by the cam on/off switching actuator 216 so that the cams do not contact the cam followers. In this state, the cams do not function (a cam non-operating state, or an ineffective state).

Figure 17A:
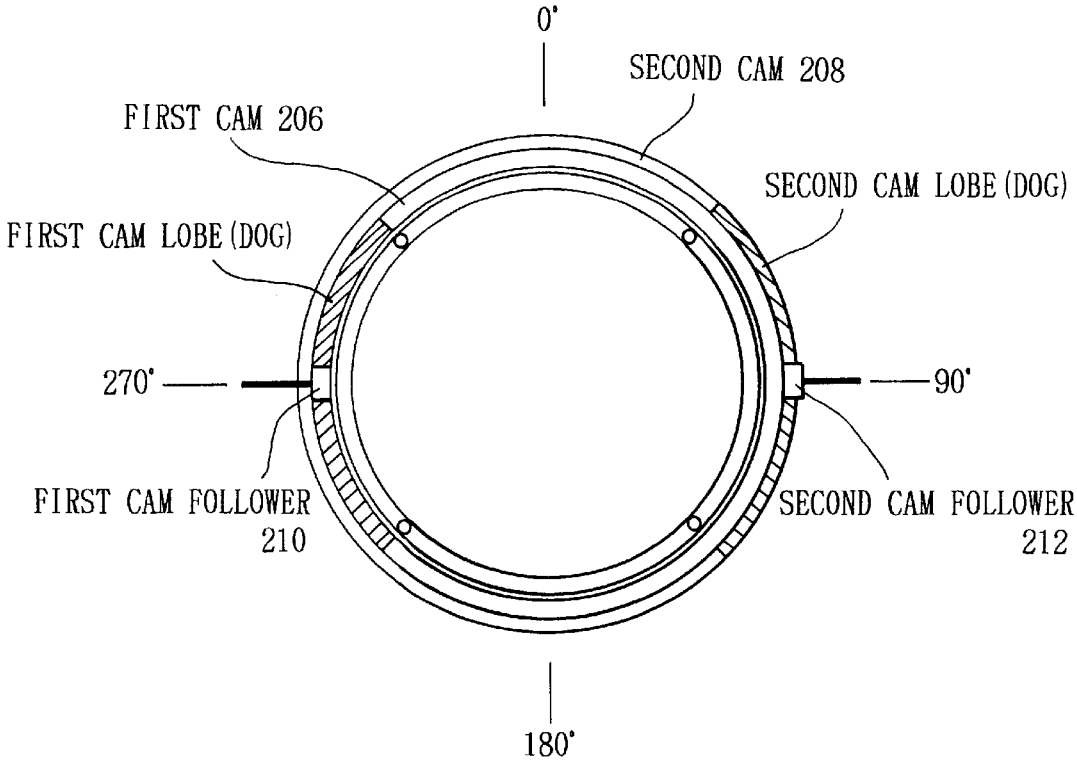
FIG. 17A illustrates a construction of a cam disc shown in FIG. 16.
Figure 17B:
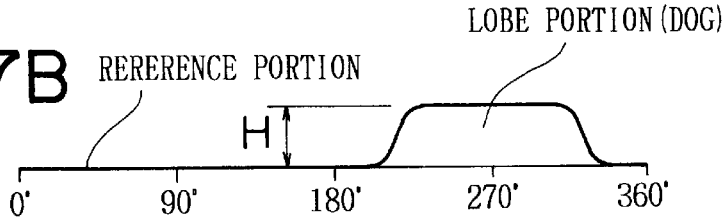
FIG. 17B indicates a first cam profile of the cam disc shown in FIG. 17A.
Figure 17C:
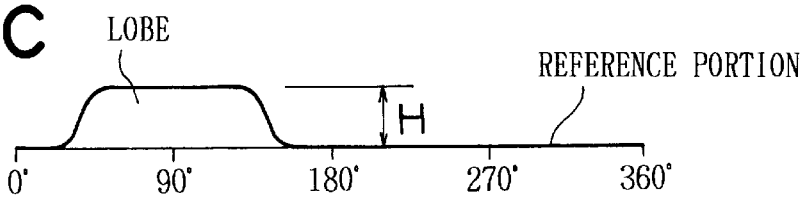
FIG. 17C indicates a second cam profile of the cam disc shown in FIG. 17A.

FIG. 17A is a view of the cam disc 200 taken in a direction of the rotational axis. The first ring cam 206 and the second ring cam 208 extend concentrically about the rotational axis, with the second ring cam 208 being more radially outward. The ring cams 206, 208 are generally-termed end surface cams that have undulations extending in the circumferential directions. The profiles of the cam surfaces of the first and second ring cams 206, 208 are shown in FIGS. 17B and 17C, respectively. The profile of the cam surface of each ring cam 206, 208 is pre-set so that the guide member 8 operates in the directions of the rotational axis in a predetermined manner. In this embodiment, a quarter of (i.e., a 90° area indicated by shading) of the cam surface of each ring cam is raised, and the remainder portion, that is, a reference portion, is lower, as indicated in FIGS. 17A to 17C. The junctions between the high and low portions are smoothly formed. The setting of the cam surface of each ring cam will be described below together with the operation of the wire winder.

As shown in FIGS. 17A to 17C, the cam followers 210, 212 are disposed at opposite sides of the rotational axis of the cam disc 200. The cam surfaces of the cam rings 206, 208 are set substantially point-symmetrically about the rotational axis, and the cam surfaces of the cam rings 206, 208 have equal level differences H between the high and low portions. That is, two cams with the same setting are provided in such a manner that the cams are shifted 180° in phase from each other. As a result, the cam followers 210, 212 simultaneously push the cam disc 200 at opposite end portions thereof with equal force. Therefore, the cam disc 200 is prevented from tilting, and the positioning of the cam disc 200 can be reliably accomplished.

Figure 18A:
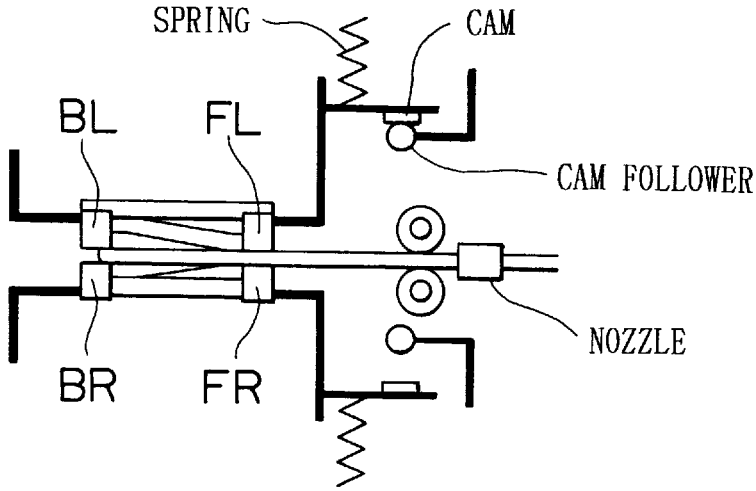
FIGS. 18A, 18B and 18C show an operation of the wire winder of the second embodiment.
Figure 18B:
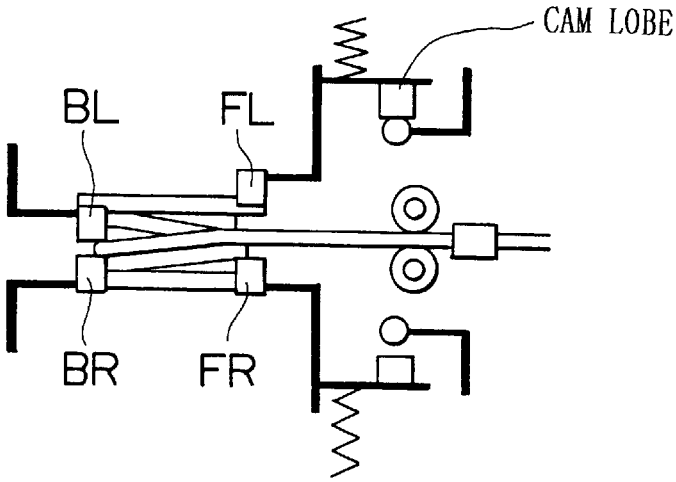
Figure 18C:
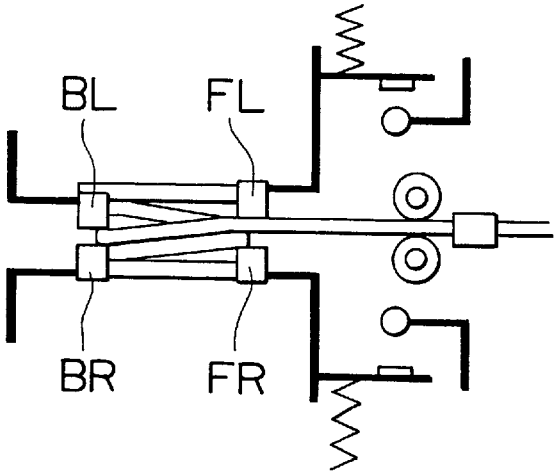

The operation of the wire winder of this embodiment will be described below with reference to FIGS. 18A to 18C. The operation will be described in the case of producing a trapezoidal coil as shown in FIG. 6, as in the description of the first embodiment. FIGS. 18A to 18C illustrate steps of winding a conductive wire for the third layer.

In each illustration of FIGS. 18A to 18C, an upper half portion of the illustration corresponds to the right-side half portion (cam operating state) of FIG. 16, and a lower half portion corresponds to the left-side half portion (cam non-operating state) of FIG. 16. Although only one cam is shown in each half of the illustration of each of FIGS. 18A to 18C, two cams are actually provided in each half portion of the wire winder as shown in FIG. 16. The operations performed by the guide tabs during the entire process of winding the third layer are substantially the same as those indicated in FIGS. 12A to 12D.

As shown in FIG. 18A, the cam shown in the upper half portion is in contact with the cam follower and therefore in the operating state. The cam shown in the lower half portion is not in contact with the cam follower and therefore in the non-operating state. The cams and the cam followers are thus positioned because only the cams in the upper portion are needed for the formation of the third layer. Therefore, the lower cam followers are withdrawn so as not to function. During the formation of a different layer or the like, however, the operating and non-operating states are switched if necessary.

The operating and non-operating states are switched by the cam on/off switching actuators (not shown in FIGS. 18A to 18C). In the state illustrated in FIGS. 18A to 18C, the cam on/off switching actuator in the upper half portion has moved the cam follower support arm to set the cam followers at a cam operating position. The cam on/off switching actuator in the lower half portion has moved the cam follower support arm to set the cam followers at a cam non-operating position (withdrawn position).

FIG. 18A shows a state assumed at the end of winding the first turn of the third layer. In the upper half portion, the cam follower is in contact with the reference portion (low portion) of the cam, that is, the portion not shaded in FIG. 17A. The cam disc has been pushed toward the winding frame by the springs. As a result, the guide tab FL has also been pushed toward the winding frame, so that the guide tabs FL, BL are at equal levels in the direction of the rotational axis of the winding frame. In the lower portion of the illustration, the cam non-operating state is assumed, and the guide tabs FR, BR always remain at equal levels in the direction of the rotational axis of the winding frame.

FIG. 18B shows a state in which the winding frame has slightly rotated from the state shown in FIG. 18A and the coil wire is about to be wound between the two guide tabs FL, FR. In this state, it is preferable to temporarily move the guide tab FL a great distance upward and then move it downward. This preferable operation, expanding the interval between the guide tabs FL and FR, facilitates the winding of the coil wire, and prevents a damage to the coil wire from being caused by contact of the wire with a guide tab.

The aforementioned up-down movements of the guide tab FL are achieved by using the cams. That is, in FIG. 18B, the cam follower (in the upper portion) is in contact with the high portion (lobe portion) of the cam. Therefore, the cam has been raised, and the guide tab FL has been moved upward. The level difference between the high and low portions of each cam surface is pre-set to a value equal to an amount of withdrawal that is needed for the guide tab FL.

In the aforementioned state, each cam follower is positioned on the lobe portion of the corresponding cam indicated by shading in FIG. 17. The cam lobe portion is hereinafter referred to as "dog portion". The cam profile is pre-set so that while the coil wire is being passed between the guide tabs, the corresponding cam follower remains on the dog portion. More specifically, the dog portion is pre-set so that while the coil wire is being wound over a side surface of the winding frame (a side surface which the guide tab FL contact), the guide tab FL is moved away from the guide tab FR independently of the guide tab BL. As a result of the setting, the range of the dog portion is 900. Although the range of the dog portion is set to 90° in this case, the range is changed in accordance with the winding operation.

FIG. 18C shows a state in which the winding frame has further rotated from the state shown in FIG. 18B. In the state shown in FIG. 18C, the cam follower has passed the lobe (dog) portion of the cam and has reached the reference portion. The cam disc and the guide tab FL have been pushed in the direction of the rotational axis by the springs. The guide tab FL is stopped at the position of contact with the coil wire, and therefore there is a gap between the cam follower and the cam. When the coil wire is wound between the guide tabs BL and BR as the winding frame further turns from the state shown in FIG. 18C, the guide tab BL is moved upward. At this moment, each cam follower is moved upward to contact the cam again. Then, the winding of the next turn is performed, following the procedure described above.

The operation of the wire winder of this embodiment has been described above. Although only a portion of the process of winding the third layer has been described, the cam mechanism operates in substantially the same manner as described above during other portions of the process of winding the third layer. That is, the guide tab is moved up and down following the cam profile when the coil wire is wound between the two guide tabs. The constructions and operations of portions of the wire winder other than the cam mechanism are substantially the same as those described in conjunction with the first embodiment.

Figure 19:
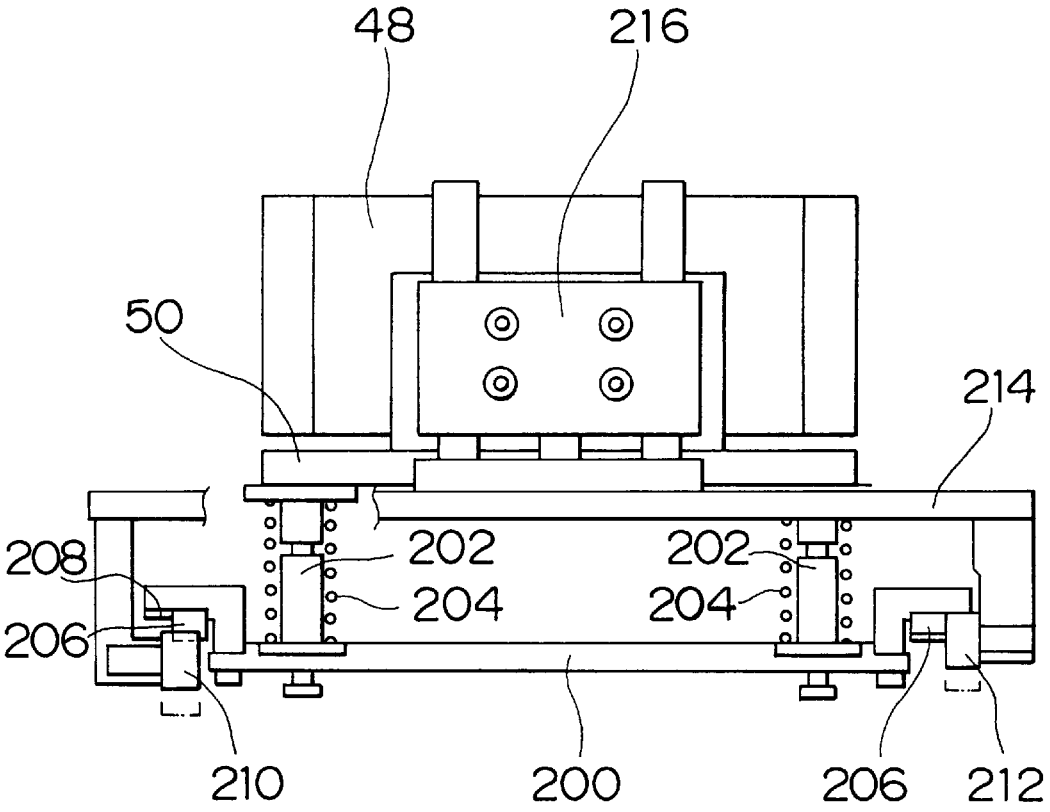
FIG. 19 illustrates a construction of the mechanism shown in FIG. 16 that is installed in a real apparatus.
Figure 20:
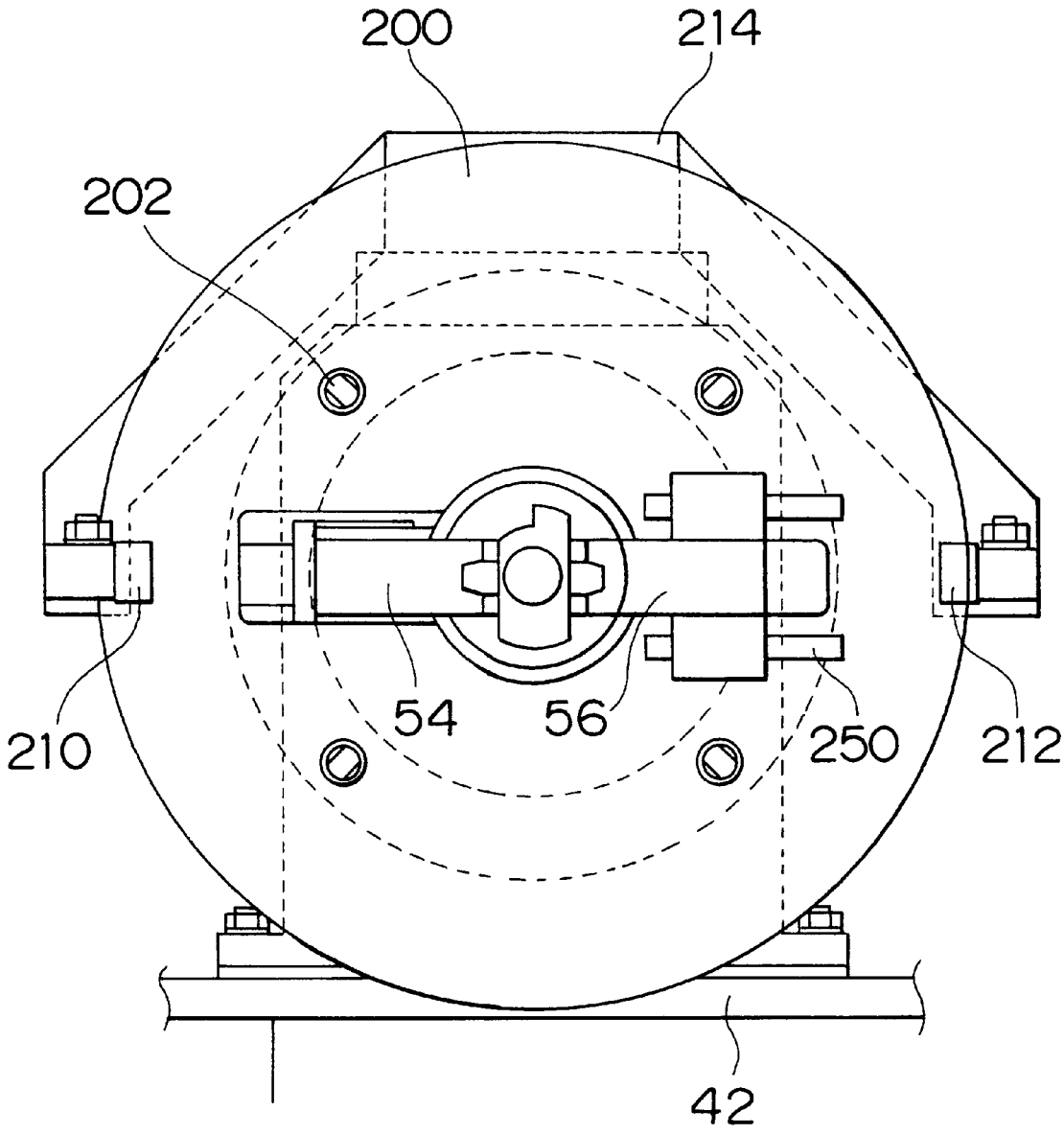
FIG. 20 is another view of the construction of the mechanism shown in FIG. 16 in the real apparatus.

A construction of the cam mechanism in a real wire winder apparatus will be described with reference to FIGS. 19 and 20. FIG. 19 is a plan view of a cam mechanism according to this embodiment, that is, a portion of the wire winder apparatus. FIG. 20 is a sectional view of the wire winder taken on a plane extending through the winding frame, showing the construction of the cam mechanism of FIG. 19 viewed in the direction of the rotational axis of the winding frame. To facilitate the understanding of the illustrations of FIGS. 19 and 20, portions of the construction are suitably omitted.

As shown in FIGS. 19 and 20, a cam disc 200 is connected to a holding ring 50 by extendable arms 202. Although four extendable arms 202 are provided in FIGS. 19 and 20, the number of extendable arms 202 is arbitrary as long as it is equal to or greater than three. Each extendable arm 202 is surrounded by a coaxial spring 204. The springs 204 urge the cam disc 200 toward the winding frame. The arrangement of springs 204 is not restricted to the illustration of FIG. 19. For example, a single spring having a large diameter may be disposed coaxially with the cam disc so that the spring surrounds the extendable arms 202.

A guide tab 56 is connected to the cam disc 200 via a rail 250 so that the guide tab 56 is slidable relative to the cam disc 200. A guide tab 54 is provided so as not to contact the cam disc 200. To maintain the non-contact positional relationship, the cam disc 200 has an escape cutout.

The cam disc 200 has two ring cams 206, 208 that extend in its peripheral portion. A first ring cam 206 contacts a first cam follower 210. A second ring cam 208 contacts a second cam follower 212. A right-side portion of FIG. 19 shows a state in which the cam follower is in contact with a cam reference portion, and a left-side portion shows a state in which the cam follower is in contact with a cam lobe portion.

The two cam followers 210, 212 are supported by a cam follower support arm 214. The cam follower support arm 214 extends one of the cam followers to the other over a rotating axis of winding flame, as best shown in FIG. 20. The cam follower support arm 214 is connected at its central portion to a guide support 48 via a cam on/off switching actuator 216. The guide support 48 is a member that supports the holding ring 50, and is fixed to a guide table 42. The cam on/off switching actuator 216 moves the cam follower support arm 214 to switch between the operating state and the non-operating state of the cams, as described above.

Thus, the apparatus shown in FIGS. 19 and 20 has a mechanism according to the invention as shown in FIG. 16.

The second preferred embodiment of the invention has been described above. This embodiment, employing the cam mechanism, withdraws guide members only when the coil wire is wound between the guide members, and causes the guide members to firmly hold a winding or windings around the winding frame, thereby making it possible to improve the dimension precision of the coil.

This embodiment, in particular, achieves the independent driving of the guide members (7, 8) disposed at opposite sides of the rotational axis of the winding frame, by using a means, such as the cam mechanism, which mechanically uses the winding frame turning force. Therefore, the embodiment eliminates a delay of operation of guide members relative to rotation of the winding frame, which may occur when using an arm extending actuator (19 shown in FIG. 4). Hence, the embodiment achieves reliable cooperation between the winding frame and the guide member.

Furthermore, this embodiment eliminates the need for the arm extending actuator 19, so that the associated control of the arm extending actuator 19 and the winding frame-rotating motor 5 becomes unnecessary. Therefore, the control of the wire winder becomes easier.

Although this embodiment eliminates the need for the arm extending actuator 19, the cam on/off switching actuator 216 shown in FIG. 16 is added to the construction of the embodiment. The cam on/off switching actuator 216 functions during a transition from one layer to another layer. The cam on/off switching actuator 216 is not required to have such a high responsiveness as is needed for the arm extending actuator 19 to cooperate with the rotation of the winding frame during the winding process for each layer. Therefore, the function of the cam on/off switching actuator 216 can be sufficiently accomplished by a low-cost cylinder or the like.

Furthermore, in this embodiment, the two ring cams coaxially extend on the rotating disc. Therefore, it becomes possible to press end portions of the disc that are located opposite to each other about the rotational axis with equal pressing forces during operation of the cams. In this manner, the rotating disc is prevented from tilting, so that the positioning of the rotating disc and the guide members can be reliably accomplished and the abrasion of the cam and adjacent members is reduced.

While the present invention has been described with reference to preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations which are exemplary, other combinations and configurations, including more, less or only a single element, are also within the spirit and scope of the present invention.

What is claimed is:

1. A wire winder for forming a coil by winding a conductive wire around a winding frame while the winding frame is being rotated about a rotational axis, the wire winder comprising:

a guide mechanism that contacts the conductive wire wound around the winding frame and that defines a winding position of the conductive wire;

a guide support link mechanism provided coaxially with the rotational axis so as to rotate synchronously with the winding frame, the guide support link mechanism supporting the guide mechanism; and a link driver that, without rotating about the rotational axis together with the winding frame and the guide support link mechanism, moves a member of the guide support link mechanism in a direction of the rotational axis, wherein the guide support link mechanism converts a movement in the direction of the rotational axis provided by the link driver into a movement of the guide mechanism in a direction of a diameter of the winding frame.

2. A wire winder according to claim 1, wherein the guide support link mechanism comprises:

a holding link that supports the guide mechanism slidably in the direction of the diameter of the winding frame;

a driving link that is movable relative to the holding link in the direction of the rotational axis; and a converting link that connects the driving link and the guide mechanism and that converts a movement of the driving link in the direction of the rotational axis into a movement of the guide mechanism on the holding link in the direction of the diameter of the winding frame.

3. A wire winder according to claim 2, wherein:

the holding link has a first cylinder that is coaxial with the rotational axis;

the driving link has a second cylinder that is coaxial with the rotational axis; and the link driver moves the second cylinder relative to the first cylinder.

4. A wire winder according to claim 3, further comprising a driver that, without rotating about the rotational axis together with the winding frame and the guide support link mechanism, moves the guide mechanism in the direction of the rotational axis by moving the guide support link mechanism relative to the winding frame in the direction of the rotational axis.

5. A wire winder according to claim 4, wherein:

the guide mechanism and the guide support link mechanism are provided at each of substantially opposite sides of the rotational axis; and the link driver is provided so as to drive the guide support link mechanisms provided at each of the opposite sides of the winding axis.

6. A wire winder according to claim 3, wherein:

the guide mechanism and the guide support link mechanism are provided at each of substantially opposite sides of the rotational axis; and the link driver is provided so as to drive the guide support link mechanisms provided at each of the opposite sides of the winding frame.

7. A wire winder according to claim 3, wherein:

the guide mechanism is comprised by a pair of guide members supported by the holding link at opposite sides of the rotational axis; and further comprising:

a driver that, without rotating about the rotational axis together with the winding frame and the guide support link mechanism, moves one of the guide members relative to the holding link in the direction of the rotational axis.

8. A wire winder according to claim 7, wherein the driver applies a force in the direction of the rotational axis to the one of the guide members while slidingly contacting the one of the guide members rotating about the rotational axis.

9. A wire winder according to claim 2, further comprising a driver that, without rotating about the rotational axis together with the winding frame and the guide support link mechanism, moves the guide mechanism in the direction of the rotational axis by moving the guide support link mechanism relative to the winding frame in the direction of the rotational axis.

10. A wire winder according to claim 9, wherein:

the guide mechanism and the guide support link mechanism are provided at each of substantially opposite sides of the rotational axis; and the link driver is provided so as to drive the guide support link mechanisms provided at each of the opposite sides of the rotational axis.

11. A wire winder according to claim 2, wherein the guide mechanism and the guide support link mechanism are provided at each of substantially opposite sides of the rotational axis; and the link driver is provided so as to drive the guide support link mechanisms provided at each of the opposite sides of the rotational axis.

12. A wire winder according to claim 2, wherein:

the guide mechanism is comprised by a pair of guide members supported by the holding link at opposite sides of the rotational axis together with the winding frame and the guide support link mechanism; and further comprising:

a driver that, without rotating about the rotational axis, moves one of the guide members relative to the holding link in the direction of the rotational axis.

13. A wire winder according to claim 12, wherein the driver applies a force in the direction of the rotational axis to the one of the guide members while slidingly contacting the one of the guide members rotating about the rotational axis.

14. A wire winder according to claim 1, further comprising a driver that, without rotating about the rotational axis together with either one of the winding frame and the guide support link mechanism, moves the guide mechanism in the direction of the rotational axis by moving the guide support link mechanism relative to the winding frame in the direction of the rotational axis.

15. A wire winder according to claim 14, wherein:

the guide mechanism and the guide support link mechanism are provided at each of substantially opposite sides of the rotational axis; and the link driver is provided so as to drive the guide support link mechanisms provided at each of the opposite sides of the rotational axis.

16. A wire winder according to claim 1, wherein:

the guide mechanism and the guide support link mechanism are provided at each of substantially opposite sides of the rotational axis; and the link driver is provided so as to drive the guide support link mechanisms provided at each of the opposite sides of the rotational axis.

17. A wire winder according to claim 1, wherein the guide mechanism comprises:

a first guide member and a second guide member that contact opposite sides of the conductive wire that face in the direction of the rotational axis, at a site forward of a turn shift portion where the conductive wire being wound around the winding frame is shifted from one turn to a next turn, the site being forward in a direction of advancement of winding of the conductive wire; and a third guide member and a fourth guide member that contact the opposite sides of the conductive wire facing in the direction of the rotational axis, at a site rearward of the turn shift portion in the direction of advancement of winding of the conductive wire, wherein the first guide member, the second guide member, the third guide member and the fourth guide member are driven independently of one another to provide the turn shift portion with a predetermined shape.

18. A wire winder according to claim 17, further comprising:

a turn-shifting driver that causes a turn shift of the conductive wire by changing a direction of supplying the conductive wire to the winding frame when a portion of the conductive wire to be wound as the turn shift portion is supplied to the winding frame, wherein the guide mechanism prevents the conductive wire on the winding frame from deviating in position when the turn-shifting driver changes the direction of supplying the conductive wire.

19. A wire winder according to claim 18, wherein one of a first pair comprised of the first guide member and the second guide member and a second pair comprised of the third guide member and the fourth guide member expand an interval between the one pair in order to receive the conductive wire in the interval, when the conductive wire is supplied toward the guide members.

20. A wire winder according to claim 19, wherein the one of the first and second pairs of guide members clamps the conductive wire from opposite ends of the coil that face in the direction of the rotational axis of the winding frame so as to prevent the conductive wire from deviating in position, after the conductive wire is supplied into the interval between the one pair of guide members.

21. A wire winder according to claim 20, wherein after the coil is formed by winding the conductive wire, at least one of the guide members moves the coil in the direction of the rotational axis to remove the coil from the winding frame.

22. A wire winder according to claim 21, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

23. A wire winder according to claim 22, wherein the mechanical mechanism includes a cam that prescribes a required operation of the guide members, and a cam follower that follows the cam.

24. A wire winder according to claim 23, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating a member.

25. A wire winder according to claim 20, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

26. A wire winder according to claim 25, wherein the mechanical mechanism includes a cam that prescribes a required operation of the guide members, and a cam follower that follows the cam.

27. A wire winder according to claim 26, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

28. A wire winder according to claim 19, wherein when the coil is formed by winding the conductive wire, at least one of the guide members moves the coil in the direction of the rotational axis to remove the coil from the winding frame.

29. A wire winder according to claim 28, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

30. A wire winder according to claim 29, wherein the mechanical mechanism includes a cam that prescribes a required operation of the guide members, and a cam follower that follows the cam.

31. A wire winder according to claim 30, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

32. A wire winder according to claim 19, wherein two guide members of the first guide member, the second guide member, the third guide member and the fourth guide member that are disposed forward and rearward of the turn shift portion in the direction of advancement of winding the conductive wire are driven independently of leach other by a mechanical mechanism that cooperates with a rotating movement of the winding frame by mechanically using a turning force of the winding frame.

33. A wire winder according to claim 32, wherein the mechanical mechanism includes a cam that prescribes a required operation of the guide members, and a cam follower that follows the cam.

34. A wire winder according to claim 33, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

35. A wire winder according to claim 18, wherein when the coil is formed by winding the conductive wire, at least one of the guide members moves the coil in the direction of the rotational axis to remove the coil from the winding frame.

36. A wire winder according to claim 35, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

37. A wire winder according to claim 36, wherein the mechanical mechanism includes a cam that prescribes a required operation of the guide members, and a cam follower that follows the cam.

38. A wire winder according to claim 37, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

39. A wire winder according to claim 18, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

40. A wire winder according to claim 39, wherein the mechanical mechanism includes a cam that prescribes a required operation of the guide members, and a cam follower that follows the cam.

41. A wire winder according to claim 40, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

42. A wire winder according to claim 17, wherein when the coil is formed by winding the conductive wire, at least one of the guide members moves the coil in the direction of the rotational axis to remove the coil from the winding frame.

43. A wire winder according to claim 42, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

44. A wire winder according to claim 43, wherein the mechanical mechanism includes a cam that prescribes a required operation of the guide members, and a cam follower that follows the cam.

45. A wire winder according to claim 44, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

46. A wire winder according to claim 17, wherein two guide members of the first guide member, the second guide member, the third guide member and the fourth guide member that are disposed forward and rearward of the turn shift portion in the direction of advancement of winding the conductive wire are driven independently of each other by a mechanical mechanism that cooperates with a rotating movement of the winding frame by mechanically using a turning force of the winding frame.

47. A wire winder according to claim 46, wherein the mechanical mechanism includes a cam that prescribes a required operation of the guide members, and a cam follower that follows the cam.

48. A wire winder according to claim 47, wherein:

the cam is an annular-shape end surface cam which is provided on a rotating member that rotates together with the winding frame and which surrounds the rotational axis;

the cam follower does not rotate together with the winding frame; and one guide member of the two guide members is connected to the rotating member.

49. A wire winder for forming a coil by winding a conductive wire around a winding frame that is rotating about a rotational axis, comprising:

an apparatus base that rotatably supports the winding frame;

a guide table that is slidable on the apparatus base in a direction of the rotational axis;

a guide support link mechanism that is provided on the guide table coaxially with the rotational axis so that the guide support link mechanism is rotatable synchronously with the winding frame;

a guide mechanism that is supported by the guide support link mechanism and that contacts the conductive wire wound around the winding frame and that defines a winding position of the conductive wire;

a link driver that is provided on one of the guide table and the apparatus base and that moves a member of the guide support link mechanism in a direction of the rotational axis, wherein the guide support link mechanism converts a movement in the direction of the rotational axis provided by the link driver into a movement of the guide mechanism in a direction of a diameter of the winding frame.

50. A method of forming a coil by winding a conductive wire around a winding frame while the winding frame is being rotated about a rotational axis, the method comprising:

contacting the conductive wire wound around the winding frame with a guide mechanism that defines a winding position of the conductive wire;

supporting the guide mechanism with a guide support link mechanism that is provided coaxially with the rotational axis so as to rotate synchronously with the winding frame; and utilizing a link driver that does not rotate about the rotational axis together with either one of the winding frame and the guide support link mechanism, to move a member of the guide support link mechanism in a direction of the rotational axis;

the guide support link mechanism converting a movement in the direction of the rotational axis provided by the link driver into a movement of the guide mechanism in a direction of a diameter of the winding frame.

51. A method according to claim 50, wherein the guide mechanism comprises:

a first guide member and a second guide member that contact opposite sides of the conductive wire that face in the direction of the rotational axis, at a site forward of a turn shift portion where the conductive wire being wound around the winding frame is shifted from one turn to a next turn, the site being forward in a direction of advancement of winding of the conductive wire; and a third guide member and a fourth guide member that contact the opposite sides of the conductive wire facing in the direction of the rotational axis, at a site rearward of the turn shift portion in the direction of advancement of winding of the conductive wire, the method further comprising driving the first guide member, the second guide member, the third guide member and the fourth guide member a independently of one another to provide the turn shift portion with a predetermined shape.

52. A method according to claim 51, further comprising:

utilizing a turn-shifting driver to cause a turn shift of the conductive wire by changing a direction of supplying the conductive wire to the winding frame when a portion of the conductive wire to be wound as the turn shift portion is supplied to the winding frame, and utilizing the guide mechanism to prevent the conductive wire on the winding frame from deviating in position when the turn-shifting driver changes the direction of supplying the conductive wire.

53. A method according to claim 52, further comprising utilizing one of a first pair comprised of the first guide member and the second guide member and a second pair comprised of the third guide member and the fourth guide member to expand an interval between the one pair in order to receive the conductive wire in the interval, when the conductive wire is supplied toward the guide members.

54. A method according to claim 53, wherein the one of the first and second pairs of guide members clamps the conductive wire from opposite ends of the coil that face in the direction of the rotational axis of the winding frame so as to prevent the conductive wire from deviating in position, after the conductive wire is supplied into the interval between the one pair of guide members.

55. A method according to claim 54, wherein after the coil is formed by winding the conductive wire, at least one of the guide members moves the coil in the direction of the rotational axis to remove the coil from the winding frame.

56. A coil produced by the wire winding method of claim 50.

* * * * *